US011639607B2

(12) United States Patent
Behrbohm

(10) Patent No.: US 11,639,607 B2
(45) Date of Patent: May 2, 2023

(54) SCAFFOLD HAVING AN ANTI-LIFT-OUT DEVICE AND METHOD FOR SECURING A SCAFFOLD PLATFORM AGAINST LIFTING OUT

(71) Applicant: Wilhelm Layher Verwaltungs-GmbH, Gueglingen-Eibensbach (DE)

(72) Inventor: Wolf Christian Behrbohm, Besigheim-Ottmarsheim (DE)

(73) Assignee: Wilhelm Layher Verwaltungs-GmbH, Gueglingen-Eibensbach (DE)

( * ) Notice: Subject to any disclaimer, the term of this patent is extended or adjusted under 35 U.S.C. 154(b) by 546 days.

(21) Appl. No.: 16/960,440

(22) PCT Filed: Jan. 15, 2019

(86) PCT No.: PCT/DE2019/100032

§ 371 (c)(1),
(2) Date: Jul. 7, 2020

(87) PCT Pub. No.: WO2019/161824

PCT Pub. Date: Aug. 29, 2019

(65) Prior Publication Data

US 2020/0347618 A1 Nov. 5, 2020

(30) Foreign Application Priority Data

Feb. 21, 2018 (DE) ..... 10 2018 103 897.6

(51) Int. Cl.
*E04G 5/08* (2006.01)
*E04G 7/28* (2006.01)
(Continued)

(52) U.S. Cl.
CPC ..... *E04G 5/08* (2013.01); *E04G 7/28* (2013.01); *E04C 2003/0473* (2013.01);
(Continued)

(58) Field of Classification Search
CPC .. E04G 5/08; E04G 7/28; E04G 1/154; E04G 2001/156; E04G 2001/158; E04C 2003/0473
See application file for complete search history.

(56) References Cited

U.S. PATENT DOCUMENTS 2,339,865 A * 1/1944 Larmour ..... E04F 19/062 52/471
4,340,130 A * 7/1982 Payne ..... E04G 1/154 182/119
(Continued)

FOREIGN PATENT DOCUMENTS

CH 439 679 A 7/1967
DE 4027754 A1 * 3/1992 ..... E04G 1/15
(Continued)

OTHER PUBLICATIONS

International Search Report in PCT/DE2019/100032, dated May 14, 2019.
(Continued)

*Primary Examiner* — Daniel P Cahn
*Assistant Examiner* — Shiref M Mekhaeil
(74) *Attorney, Agent, or Firm* — Collard & Roe, P.C.

(57) ABSTRACT

A scaffold includes a U-profile beam having an outwardly-open U-profile in which a scaffold platform is releasably hooked by mounting hooks. The U-profile beam has a perpendicular wall delimiting the U-profile and a guiding and fastening groove delimited by inwardly-extending groove reach-behind protrusions delimiting a locking space for releasably locking a locking element reaching behind the protrusions. An anti-lift-out and support element has an anti-lift-out element extending over the hooks to prevent lifting out. A support element fixed to the anti-lift-out element extends perpendicularly from the anti-lift-out element to a support element end for supporting the support
(Continued)

element on the wall. The anti-lift-out element has a through-opening designed so that the fastening element moves the locking element toward the fastening element longitudinal axis and perpendicularly to the groove through the through-opening. A method secures scaffold platform mounting hooks against lifting out from a U-profile beam using an anti-lift-out device.

15 Claims, 19 Drawing Sheets

(51) Int. Cl.
*E04C 3/04* (2006.01)
*E04G 1/15* (2006.01)

(52) U.S. Cl.
CPC ..... *E04G 1/154* (2013.01); *E04G 2001/156* (2013.01); *E04G 2001/158* (2013.01)

(56) References Cited

U.S. PATENT DOCUMENTS 4,372,424 A * 2/1983 Langer ..... E04G 7/28 182/119
5,145,032 A * 9/1992 Puccinelli ..... E04G 3/30 182/119
6,000,495 A * 12/1999 Brinegar ..... E04G 1/154 403/381
8,931,594 B2 * 1/2015 Kreller ..... E04G 7/307 182/186.7
10,604,951 B2 * 3/2020 Jablonski ..... E04G 7/28
2011/0036665 A1 * 2/2011 Kreller ..... E04G 7/28 182/179.1
2018/0119435 A1 * 5/2018 Jablonski ..... E04G 5/08
2020/0056384 A1 * 2/2020 Curtis ..... E04G 5/08
2020/0332537 A1 * 10/2020 Behrbohm ..... E04G 5/165
2020/0340259 A1 * 10/2020 Garcia ..... E04G 7/02

FOREIGN PATENT DOCUMENTS

DE 195 11 847 A1 10/1996
DE 10 2013 102 492 A1 9/2014
DE 10 2014 112 041 A1 2/2016
DE 10 2016 103 224 A1 8/2017
EP 1 845 215 A1 10/2007
EP 1 961 886 A2 8/2008

OTHER PUBLICATIONS

English translation of the International Preliminary Report on Patentability and Written Opinion of the International Searching Authority in PCT/DE2019/100032, dated Aug. 27, 2020.

* cited by examiner

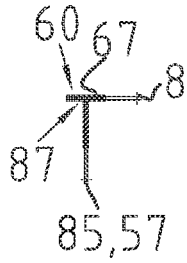
Fig. 12.1
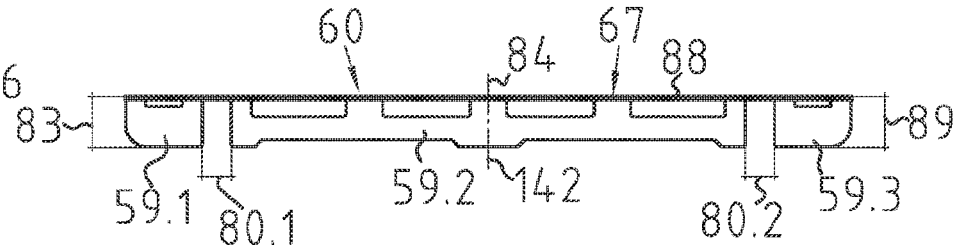
Fig. 12.2
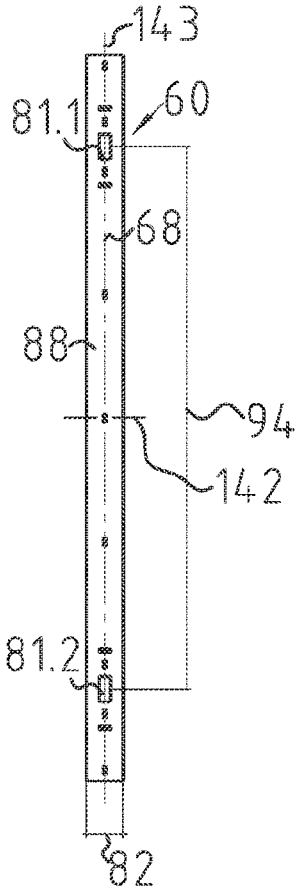
Fig. 12.3

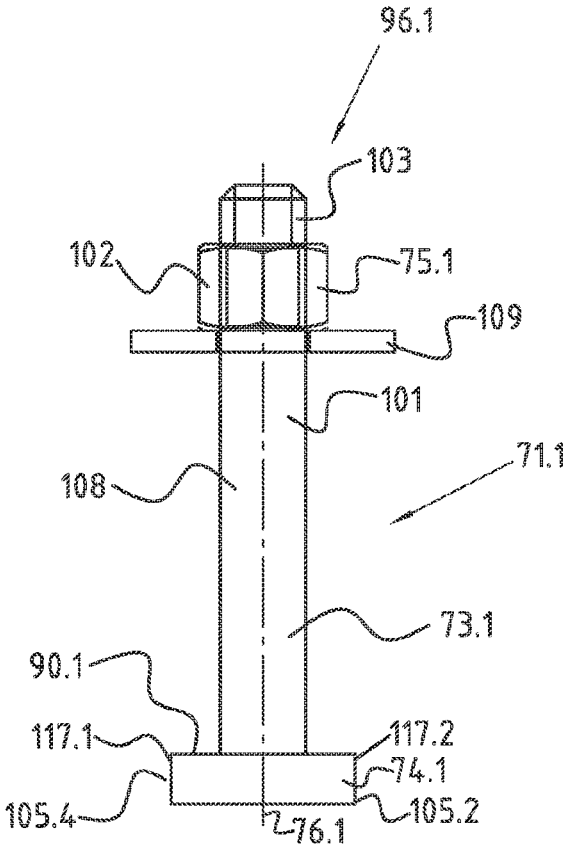
Fig. 14.1
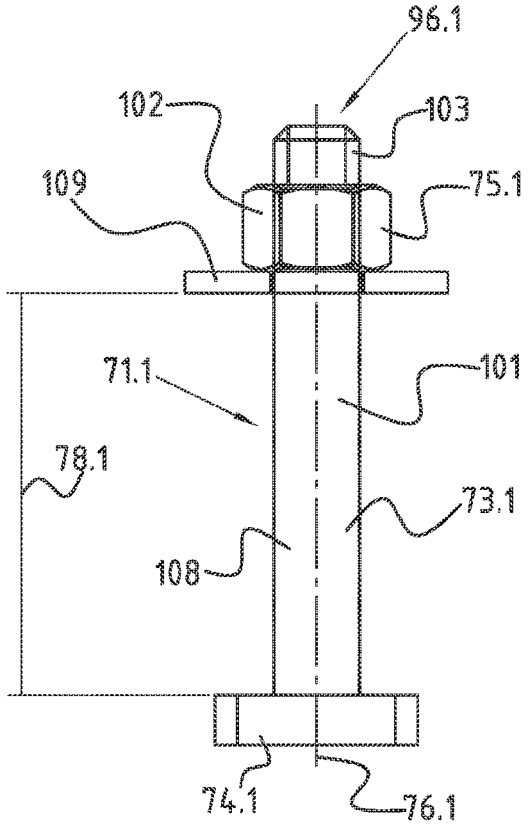
Fig. 14.2
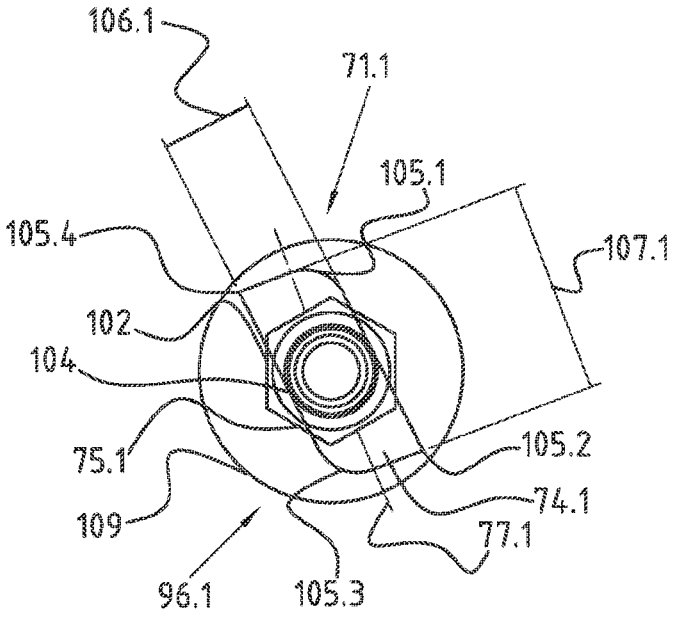
Fig. 14.3

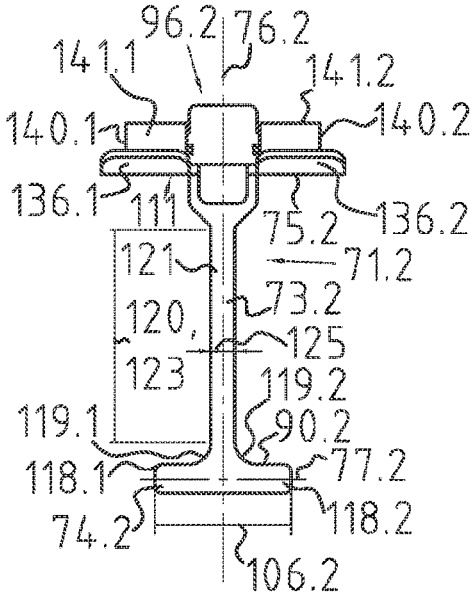
Fig. 16.1
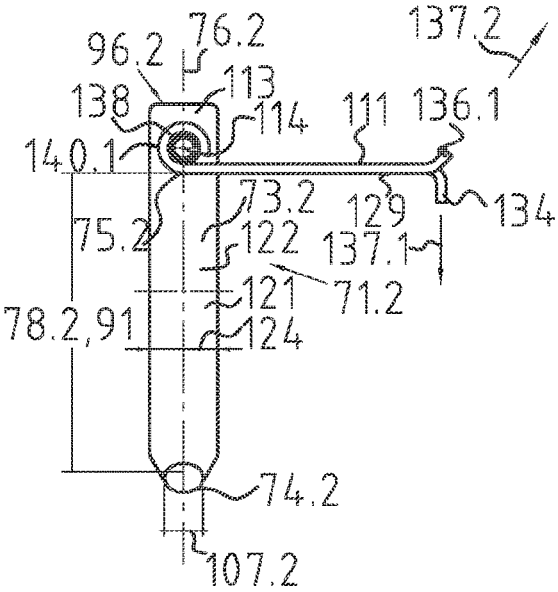
Fig. 16.2
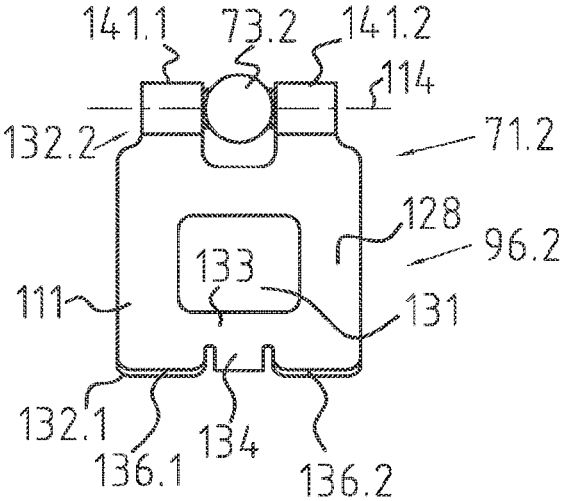
Fig. 16.3

SCAFFOLD HAVING AN ANTI-LIFT-OUT DEVICE AND METHOD FOR SECURING A SCAFFOLD PLATFORM AGAINST LIFTING OUT

CROSS REFERENCE TO RELATED APPLICATIONS

This application is the National Stage of PCT/DE2019/100032 filed on Jan. 15, 2019, which claims priority under 35 U.S.C. § 119 of German Application No. 10 2018 103 897.6 filed on Feb. 21, 2018, the disclosure of which is incorporated by reference. The international application under PCT article 21(2) was not published in English.

The invention relates to scaffolding, particularly scaffolding which can be hung or is hung as hanging scaffolding, comprising a preferably elongate U-section beam, which is constructed as, in particular, an extruded light-metal U-section beam or aluminium extruded U-section beam and which extends along the U-section beam longitudinal axis thereof and has an outwardly open U profile, and comprising at least one scaffolding floor, which is detachably fixed to the U profile and which has at an end one or more suspension hooks, for example in the form of one or more claws or talons, for suspension in the U profile, and comprising at least one anti-lift-out device, which is detachably connected with the U-section beam and which includes a fastening device and an anti-lift-out body, wherein the U profile of the U-section beam has support limbs which are arranged parallel to one another and parallel to the longitudinal centre plane of the U profile and are connected together by a transverse wall and which have, preferably at their free ends, support edges for the laying-on of the suspension hook or the suspension hooks of the at least one scaffolding floor, and wherein the suspension hook or hooks of the at least one scaffolding floor is or are detachably laid on at least one support edge of the support edges, and wherein the U-section beam has a guiding and fastening groove, which is bounded by the transverse wall and is open in the direction of the support edges of the support limbs as well as towards the inner sides thereof and which extends in a transverse direction transversely to the support limbs and in a longitudinal direction transversely or perpendicularly to the transverse direction in the direction of its longitudinal axis, preferably parallel to the U-section beam longitudinal axis of the U-section beam, and, with formation of a longitudinal slot, is bounded by groove engagement-behind webs, which are arranged at a mutual spacing and along the inner sides of the two support limbs and extend respectively inwardly therefrom and which bound a locking space of the guiding and fastening groove, in which a locking body can be releasably arranged at several positions along the guiding and fastening groove, and wherein the fastening device of the anti-lift-out device comprises a preferably rod-shaped fastening body, the locking body, which is preferably connected with the fastening body, and a securing body, and wherein the fastening body extends in the direction of the fastening body longitudinal axis thereof transversely or perpendicularly to the anti-lift-out body, and wherein the securing body is arranged at the fastening body at a spacing from the locking body, and wherein the locking body is fastened to the fastening body and extends in the direction of the locking body longitudinal axis thereof transversely or perpendicularly to the fastening body longitudinal axis of the fastening body, and wherein the locking body is transferred into a locking setting in which it engages behind the groove engagement-behind webs of the guiding and fastening groove and in which it is releasably fastened in the locking space of the guiding and fastening groove, and wherein the locking body is rotatable by means of or by way of the fastening body about the fastening body longitudinal axis from its locking setting into an unlocking setting in which the locking body is movable by means of or by way of the fastening body in a direction transverse or perpendicular to the longitudinal axis of the guiding and fastening groove away from the transverse wall out of the guiding and fastening groove through the longitudinal slot, and wherein the anti-lift-out body has a passage opening through which the fastening body is inserted so as to be rotatable about the fastening body longitudinal axis thereof relative to the anti-lift-out body, and wherein the anti-lift-out body engages over the suspension hook or hooks, and wherein the anti-lift-out body by means of the securing body by way of the fastening body and the locking body secures the suspension hook or hooks against lifting out of the U profile in a direction transverse or perpendicular to the U section beam longitudinal axis.

The invention also relates to a method for securing at least one scaffolding floor of scaffolding, which can be hung or is hung, particularly as hanging scaffolding, against lifting out of one or more suspension hooks, for example in the form of one or more claws or talons, which are arranged at an end of the at least one scaffolding floor, from a U profile of a preferably elongate U-section beam, which is constructed particularly as an extruded light-metal U-section beam or aluminium extruded U-section beam, wherein the outwardly open U profile of the U-section beam extending along the U-section beam longitudinal axis thereof has support limbs which are arranged parallel to one another and parallel to the longitudinal centre plane of the U-profile and are connected together by a transverse wall and which have, preferably at their free ends, support edges for the laying-on of the suspension hook or the suspension hooks of the at least one scaffolding floor, and wherein the U-section beam has a guiding and fastening groove, which is bounded by the transverse wall and is open in the direction of the support edges of the support limbs as well as towards the inner sides thereof and which extends in a transverse direction transversely to the support limbs and in a longitudinal direction transversely or perpendicularly to the transverse direction in the direction of its longitudinal axis, preferably parallel to the U-section beam longitudinal axis of the U-section beam, and, with formation of a longitudinal slot, is bounded by groove engagement-behind webs, which are arranged at a mutual spacing and along the inner sides of the two support limbs and extend respectively inwardly therefrom and which bound a locking space of the guiding and fastening groove, in which a locking body can be releasably arranged at several positions along the guiding and fastening groove, wherein in a first method step the suspension hook or hooks of the at least one scaffolding floor is or are detachably laid on at least one support edge of the support edges of the support limbs of the U profile of the U-section beam, wherein in a succeeding second method step at least one anti-lift-out device—which includes an anti-lift-out body and a fastening device, which comprises a preferably rod-shaped fastening body, the locking body, which is preferably rigidly connected with the fastening body, and a securing body, wherein the fastening body extends in the direction of the fastening body longitudinal axis thereof transversely or perpendicularly to the anti-lift-out body and wherein the securing body is arranged at or fastened at the fastening body at a spacing from the locking body and wherein the locking body is fastened to the fasting body and extends in the direction of the locking body longitudinal axis thereof transversely or perpendicularly to the fastening body longitudinal axis of the fastening body—is mounted in such a way that the anti-lift-out body engages over the suspension hook or hooks of the at least one scaffolding floor and is detachably fastened by means of the securing body by way of the fastening body and the locking body to the U-section beam in such a way that the suspension hook or hooks is or are secured against lifting in a direction transverse or perpendicular to the U-section beam longitudinal axis out of the U profile, wherein during performance of the second method step the locking body is transferred into an insertion setting in which it is inserted in a direction transverse or perpendicular to the longitudinal axis of the guiding and fastening groove towards the transverse wall through the longitudinal slot into the guiding and fastening groove, wherein the locking body is then disposed in an unlocking setting, after which the locking body is rotated by means of or by way of the fastening body about the fastening body longitudinal axis thereof relative to the U profile in the guiding and fastening groove until in a locking setting in which the locking body engages behind the groove engagement-behind webs of the guiding and fastening groove and in which it is releasably fastened in the locking space of the guiding and fastening groove.

Scaffolding of that kind and a method of that kind have become known from EP 1 845 215 A1 and the parallel EP 1 961 886 A2. In those, a suspension hook of a scaffolding floor is secured by means of an anti-lift-out body, which engages over the suspension hook and is in the form of an apertured disc, against lifting out of a U profile, which is formed by two parallel support limbs, of a U-section beam. The U-section beam has on its side facing away from the U profile a connecting part integrally connected therewith. The connecting part has two fastening limbs, which respectively extend laterally over the two support limbs of the U profile and by way of which the U-section beam is detachably fastened by means of a connecting tube coupling, which is formed by a coupling half shell, to an elongate scaffolding tube. The apertured disc has a passage through which a securing strap is inserted, which has at its securing strap end facing the U profile a groove block detachably fastened in a guide groove of the U-section beam. The apertured disc is clamped in the region of a securing strap end, which faces away from the U profile, of the securing strap by means of a securing wedge, which engages over the apertured disc, against the suspension hook of the scaffolding floor, which in turn is clamped fast by way of the apertured disc to the associated support edge of the U profile relative to the latter. As a result, the suspension hook and consequently the scaffolding floor cannot be displaced relative to the longitudinal axis of the U profile of the U-section beam. In order to make this possible, the securing wedge initially would have to be released, with elimination of the clamping, by means of a tool such as, for example, a hammer. Then, however, there was the risk of unintended lifting of the suspension hook of the scaffolding floor out of the U profile and consequently dropping down of the scaffolding floor in conjunction with a risk to life and limb. Moreover, the apertured disc in the case of an only-then possible displacement of the anti-lift-out device would under gravitational force slip down along the U profile into a free space present between adjacent suspension hooks either of the scaffolding floor or of adjacent scaffolding floors or entirely slip down into this free space between the two adjacent suspension hooks, so that then further displacement of the anti-lift-out device would no longer be possible without raising of the apertured disc back to at least its clamping height position.

A construction scaffolding has become from CH 439 679 PS, in which there are catwalks, which are formed from catwalk frames and wood fillings therein and in which the catwalk frames are provided with cross members of downwardly open suspension U profile members. The suspension U profile members respectively extend along a transverse connecting web of a vertical support frame of the construction scaffolding. The transverse connecting web is an upwardly open U-section web. Serving to secure the suspension of the suspension U profile members of the scaffolding floor is a cylindrical screw which penetrates the transverse connecting web in a passage bore and which is rigidly connected at the top with an abutment plate. A spacer consisting of an upwardly open U-section member, which has a passage bore through which the screw extends, is arranged under the abutment plate between this and a base of the upwardly open U-section transverse connecting web. The abutment plate, which is also termed pressure plate, of the screw is formed as a rectangular plate, wherein the abutment plate longitudinal axis thereof extends transversely, i.e. perpendicularly to the longitudinal axis of the transverse connecting web. The screw is provided at its screw end, which protrudes at the underside of the transverse connecting web, with a nut. Through tightening the nut the abutment plate of the screw is pressed against the suspended suspension U profile members and secures the latter against unhooking. By virtue of the spacer, excess transverse play of the suspension U profile members of the scaffolding floors in the upwardly open U-section transverse connecting web is avoided. This securing device has, in the final analysis, the same disadvantages as the afore-mentioned construction.

It is an object of the invention to make available scaffolding or hanging scaffolding and a method of the kind stated in the introduction which makes possible—with a simpler and more secure capability of mounting of its anti-lift-out device—a greater degree of assembly flexibility, particularly with respect to scaffolding components able to be fastened to or supported on the U-section beam.

According to the invention this object is fulfilled, in the case of scaffolding of the kind stated in the introduction, particularly according to claim 1, in that the anti-lift-out body extending in the direction of the anti-lift-out body longitudinal axis thereof, particularly parallel to the U-section beam longitudinal axis of the U-section beam, is a component of an anti-lift-out and support body, which comprises a support body, which is fixedly or rigidly connected—particularly by welding—with the anti-lift-out body and which extends transversely or perpendicularly away from the anti-lift-out body up to a support body end and is supported by its support body end on the transverse wall of the U-section beam, and in that the passage opening of the anti-lift-out body is formed in such a way that the locking body is movable by means of or by way of the fastening body in the direction of the fastening body longitudinal axis thereof as well as transversely or perpendicularly to the longitudinal axis of the guiding and fastening groove through the passage opening of the anti-lift-out body, preferably insertable and reinsertable thereat.

It can thereby be achieved that in the case of displacement of the anti-lift-out and support body in a displacement direction along the U profile of the U-section beam into a displacement setting, in which it no longer engages over the at least one suspension hook or the at least two suspension hooks of the at least one scaffolding floor, the anti-lift-off body maintains its spacing from or height relative to the transverse wall so that the displacement along the U profile in the displacement direction to over the succeeding suspension hook of the at least one scaffolding floor or a succeeding suspension hook of a further scaffolding floor next following in the displacement direction, particularly through tilting or tipping down of the anti-lift-out body in the direction of the U profile, is not blocked.

According to the invention the aforesaid object is fulfilled in the case of a method of the aforesaid kind, particularly according to claim 14, in that during performance of the second method step an anti-lift-out and support body, which includes the anti-lift-out body, which extends in the direction of the anti-lift-out body longitudinal axis thereof, preferably parallel to the U-section beam longitudinal axis of the U-section beam, and a support body, which is fixedly or rigidly connected—particularly by welding—with the anti-lift-out body and extends transversely or perpendicularly away from the anti-lift-out body up to its support body end, is so arranged that the support body end of the support body is supported on the transverse wall of the U-section beam, and—preferably subsequently—the locking body is inserted by means of or by way of the fastening body in the direction of the fastening body longitudinal axis thereof as well as transversely or perpendicularly to the longitudinal axis of the guiding and fastening groove through a passage opening of the anti-lift-out body of the anti-lift-out and support body and subsequently is inserted by means of or by way of the fastening body in the direction of the fastening body longitudinal axis thereof as well as transversely or perpendicularly to the longitudinal axis of the guiding and fastening groove through the longitudinal slot into the guiding and fastening groove, wherein then the locking body is disposed in its unlocking setting, after which the locking body by means of or by way of the fastening body, is rotated about the fastening body longitudinal axis thereof relative to the U profile into its locking setting.

According to a particularly advantageous variant of the method it can be provided that during performance of the second method step the support body of the anti-lift-out and support body is inserted by its support body end in a direction transverse or perpendicular to the longitudinal axis of the guiding and fastening groove through the longitudinal slot into the guiding and fastening groove, after which the support body penetrating the guiding and fastening groove transversely or perpendicularly to the longitudinal axis thereof is supported by its support body end on the transverse wall of the U section beam. The support body is thus not inserted or pushed into the guiding and fastening groove. This means a significant simplification of assembly.

The following optional measures relate not only to possible developments or variants of the scaffolding according to the invention, but also to possible developments or variants of the method according to the invention.

According to an advantageous development it can be provided that the anti-lift-out and support body, which is supported by the support body end of its support body on the transverse wall of the U-section beam, is matched in configuration to the suspension hook or hooks, which rests or rest on the first support edge of the support edges of the support limbs of the U profile, of the at least one scaffolding floor and on the U profile of the U-section beam in such a way that the suspension hooks of the at least one scaffolding floor and consequently the at least one scaffolding floor are movable relative to the U profile of the U-section beam or displaceable in the U-section beam longitudinal direction thereof and that, depending of the selected fastening device and on the fastening thereof, the anti-lift-out and support body is displaceable relative to the U profile and thus also relative to the suspension hook or hooks in the U-section beam longitudinal direction. An even greater flexibility of assembly thereby results.

According to a particularly preferred development it can be provided that a gap is formed between the anti-lift-out body of the anti-lift-out and support body and the suspension hook or hooks, which is or are engaged over by the anti-lift-out body, of the at least one scaffolding floor. As a result, not only the suspension hook or hooks of the at least one scaffolding floor, but also the anti-lift-out and support body can be displaced along the U-section beam. This means an even greater flexibility of assembly. Even if in the case of this embodiment the anti-lift-out and locking body is secured against displacement along the U profile or clamped fast to the U-section beam or the U profile thereof, the suspension hook or the suspension hooks of the at least one scaffolding floor is or are displaceable along the U profile.

According to a particularly preferred development it can be provided that the transverse wall of the U-section beam has a guide groove, which is open towards the locking space of the guiding and fastening groove and which extends in a guide groove longitudinal direction parallel to the longitudinal axis of the guiding and fastening groove, and that the support body is supported by its support body end on a groove base of the guide groove of the transverse wall of the U-section beam. As a result, an even better and still more secure load introduction of any loads acting on the anti-lift-out body of the anti-lift-out and support body and particularly good guidance during or for displacement of the anti-lift-out and support body along the U-section beam is possible.

The foregoing advantages can be achieved to a particular degree if, as considered in a direction perpendicular to the longitudinal centre plane of the U profile, the guide groove has a minimum guide groove width which is only slightly larger than a maximum width of the support body end of the support body.

According to a development it can be provided that the U-section beam is formed symmetrically with respect to a longitudinal centre plane which includes the longitudinal centre plane of the U profile. As a result, further assembly advantages can be achieved.

According to a development it can be provided that the U-section beam has a box-shaped elongate hollow profile which in cross-section is cross-sectionally closed substantially rectangularly. As a result, the stability of the U-section beam can be increased for the same reduced weight, whereby further assembly advantages are achievable.

According to a development it can be provided that the hollow profile is formed by the transverse wall and by a lower wall, which bounds a base of the hollow profile, as well as by two outer walls, which respectively extend perpendicularly away therefrom and in the direction of the transverse wall as well as parallelly to one another and which extend parallel to the support limbs—which are preferably bounded by planar or flat-plane outer surfaces—of the U profile of the U-section beam and the preferably planar or flat-plane outer surfaces thereof align with the preferably planar or flat-plane outer surfaces of the support limbs. As a result, quite special assembly advantages and a further increased assembly flexibility with respect to scaffolding components, which can be supported on or fastened to the U-section beam, can be achieved.

In that case it can be provided that the hollow profile as considered in a direction perpendicular to the longitudinal centre plane of the U profile has a hollow profile width and, as considered perpendicularly to this direction, a hollow profile length which is very much larger than the hollow profile width and/or that the U-section beam as considered in a direction perpendicular to the longitudinal centre plane of its U profile has a U-section beam width and as considered perpendicularly to this direction has a U-section beam length which is very much larger than the U-section beam width.

According to a preferred development it can be provided that the fastening body and the locking body are integrally connected or that the fastening body and the locking body are produced from one piece, particularly by forging. Assembly capability and reliability can thereby be improved.

According to a development it can be provided in accordance with a first alternative that the fastening device is a clamping-fast device comprising a screw-and-nut locking unit in which a screw and a nut are screwed together and the fastening body is a first threaded body (screw or nut) with a first thread, which is screwed together with a second thread of the securing body, which is formed as a second threaded body (nut or screw). This makes possible—particularly in those cases in which the anti-lift-out and support body is to be arranged to lie outwardly with respect to a U-section beam end of the U-section beam or with respect to at least one adjacently arranged further anti-lift-out device, particularly in the region of one of the U-section beam ends of the U-section beam—clamping fast of the anti-lift-out and support body to the U-section beam without additional measures having to be undertaken. As a result, not only can scaffolding floors be mounted on the U-section beam right up to the U-section beam ends thereof, but also auxiliary components such as, for example, post connectors for connection and support of scaffolding posts to and on the U-section beam, beam connectors for flexible direct or indirect supporting and/or fastening of the U-section beam and hanging means for hanging the U-section beam.

In that case it can be provided that the anti-lift-out and support body is so detachably screw-connected by means of the screw-and-nut locking unit of the clamping-fast device with the U-section beam that the anti-lift-out and support body is not displaceable relative to the U-section beam in the direction of the U-section beam longitudinal axis thereof. As a result, the foregoing advantages can be realised to a particular degree.

Particularly when the fastening device is the clamping-fast device it can be provided that the locking body is constructed as a groove block or hammer head. In that case it can be provided that the locking body is rounded at least at two diametrically opposite edges or at its locking body ends facing away from one another. As a result, on the one hand rotation of the locking body about the fastening body longitudinal axis can be made possible and on the other hand the angle of rotation can be limited by bearing of the two other edges of the locking body in the locking setting, which corresponds with a rotation of approximately 90 degrees, against groove walls of the guiding and fastening groove.

The locking body, particularly the clamping-fast device, can preferably be of block-shaped form.

According to a development it can be provided in accordance with a second alternative that the fastening device is a quick-action locking device comprising a securing element locking unit with a securing element, which unit embraces or engages around the securing body and is fastened to a fastening body end—which faces away from the locking body—of the fastening body to be pivotable about a transverse axis, which extends transversely or perpendicularly to the fastening body longitudinal axis, from at least one manipulation setting into a securing setting relative to the anti-lift-out and support body, in which securing setting the securing element and consequently the fastening body pivotably fastened thereto and the locking body fastened thereto are secured against unintended rotation about the fastening body longitudinal axis from the locking setting of the locking body into the unlocking setting of the locking body. As a result, a particularly simple and rapid locking or unlocking of the anti-lift-out device at the U-section beam and securing of the suspension hook or suspension hooks against lifting out of the U profile can be realised and at the same time there are particularly advantageous possibilities for the purpose of displacing the suspension hook or suspension hooks and/or the anti-lift-out and support body along the U-section beam. This signifies particularly flexible assembly possibilities, especially with respect to scaffolding components able to be fastened to or supported on the U-section beam.

In that case, according to a development it can be provided that the securing element in its at least one manipulation setting can be designed or serve for manual rotation of the locking body about the fastening body longitudinal axis from its locking setting to its unlocking setting and conversely. When the locking body is in its unlocking setting, the securing element in its at least one manipulation setting can be configured or serve for manual withdrawal of the locking body together with the fastening body from the guiding and fastening groove and from the passage opening of the anti-lift-out body. When the locking body is in its unlocking setting, the securing element in its at least one manipulation setting can be configured or serve for manual insertion and penetration of the locking body together with the fastening body into and through the passage opening of the anti-lift-out body as well as for insertion of the locking body into the guiding and fastening groove.

According to a particularly preferred development it can be provided that the anti-lift-out and support body is detachably fastened by means of the quick-action locking device to the U-section beam in such a way that the anti-lift-out and support body at least in the at least one manipulation setting of the securing element or in both the at least one manipulation setting of the securing element and the securing setting of the securing element or in all pivot settings in which the securing element in the mounted state of the quick-action locking device is pivotable about the transverse axis relative to the anti-lift-out and support body, is displaceable in a displacement direction parallel to the U-section beam longitudinal axis relative to the U-section beam. These measures make possible an even greater degree of assembly flexibility.

According to a development it can be provided that the securing body and the locking body as considered in the direction of the fastening body longitudinal axis are substantially not movable or displaceable or are substantially not movable or displaceable relative to one another. As a result, an easy displacement, which has low susceptibility to jamming or is free of jamming, of the anti-lift-out device along the U-section beam is made possible or ensured.

According to a preferred development it can be provided that the locking body, which extends along the locking body longitudinal axis thereof, of the quick-action locking device is convexly rounded substantially overall or is outwardly curved substantially overall. This makes possible even easier displacement, which is free of jamming, of the anti-lift-out device along the U-section beam.

According to a development it can be provided that the locking body, which extends along the locking body longitudinal axis thereof, of the quick-action locking device has locking body ends which extend from the fastening body in opposite directions, preferably parallelly to one another, wherein a concavely rounded or inwardly curved transition region is formed between each locking body end of the locking body ends and the fastening body. This makes possible even easier displacement, which is free of jamming, of the anti-lift-out device along the U-section beam.

According to a particularly preferred development it can be provided that the fastening body, which extends along the fastening body longitudinal axis thereof, of the quick-action locking device is formed in a length region between the locking body and the securing body with a preferably sword-shaped or blade-shaped flat web extending in a direction along or parallel to the anti-lift-out body longitudinal axis. This makes possible even easier displacement, which is free of jamming, of the anti-lift-out device along the U-section beam.

The flat web can have, preferably over its entire flat web length or height, as considered in a notional plane perpendicular to the fastening body longitudinal axis and as considered in a direction perpendicular to the anti-lift-out body longitudinal axis, a maximum thickness and, as considered in a direction parallel to the anti-lift-out body longitudinal axis, a maximum width which is, in particular, at least twice or at least three times larger than the maximum thickness of the flat web. Consequently, the guidance and displacement relationships can be still further improved.

According to a development it can be provided that the flat web in the length region has over its entire flattest length convexly rounded edges or over its outer circumference is formed to be outwardly curved and/or in a notional sectional plane perpendicular to the fastening body longitudinal axis has an elliptical flat-web cross-section. The guidance and displaceability relationships can thereby be even further improved.

According to a development it can be provided that the maximum thickness of the fastening body in its length region is smaller than a minimum spacing of the suspension hooks, which are laid on the first support edge of a first support limb of the support limbs of the U profile, of the at least one scaffolding floor from further suspension hooks, which are opposite the suspension hooks and are arranged at an end of at least one further scaffolding floor and which are laid on the second support edge of a second support limb of the support limbs of the U profile. It is thereby possible to displace the anti-lift-out device together with its fastening body along the U-section beam without collision with the suspension hooks of the scaffolding floor.

According to a preferred development it can be provided that the securing body of the quick-action locking device extends in a direction parallel to the locking body longitudinal axis. As a result, a particularly high degree of security against lifting out of the suspension hook or the suspension hooks can be achieved and in addition manipulation as well as securing of the quick-action locking device can thereby be improved.

According to a development it can be provided that the securing element of the quick-action locking device consists of or is forged from a metal sheet. In the first case, cost-saving effects and a low weight can be achieved. In the second case, the stability of the securing element can be increased.

According to a development it can be provided that the securing element of the quick-action locking device comprises a plate-shaped section for support on a surface, which faces away from the support body end of the support body, of the anti-lift-out body. This enables simplified manipulation, reduced costs and a reduced weight.

According to a preferred development it can be provided that the securing element, preferably the plate-shaped section, has a grip opening for the gripping of at least one finger or for the gripping of at least two fingers of a hand of an assembler, wherein the grip opening is bounded at a securing element end, which faces away from the securing body, by a web. Consequently, the assembler can grip and actuate the securing element at least in its manipulation setting by one hand in such a way that the assembler grips by at least one finger of his or her hand through the grip opening or that the assembler grips by at least two fingers of his or her hand through the grip opening.

According to a particularly preferred development it can be provided that the securing element or the plate-shaped section of the securing element has, preferably at a or at the securing element end facing away from the securing body, an anti-twist body which in the securing setting of the securing flap releasably engages in a securing recess or securing passage of the anti-lift-out body. As a result, there is made possible, by particularly simple and economic means, an especially simple and secure locking of the securing element and thus the locking of the locking body against unintended rotation of the locking body.

According to an advantageous development it can be provided that the securing element or the plate-shaped section of the securing element has at a or the first securing element end facing away from the securing body at least one actuating limb for manual pivotation of the securing element from its locking setting into its at least one manipulation setting. Simplified and improved manual manipulation can thereby be achieved.

According to a development it can be provided that the anti-twist body is flanged or bent away from the metal sheet in a first direction, wherein the anti-twist body extends in the recess or in the passage of the anti-lift-out body when the securing plate bears on the anti-lift-out body. As a result, production costs can be reduced and locking security further increased.

According to a development it can be provided that the actuating limb is flanged or bent away from the metal sheet in a second direction, preferably away from the anti-twist body, wherein the actuating limb extends obliquely, particularly upwardly, away from the anti-lift-out body when the securing plate bears on the anti-lift-out body. Production costs can thereby be further reduced and manipulation further improved.

According to a preferred development it can be provided that at least one bearing body, preferably at least one pin or at least one bearing dowel, is fastened to the fastening body end, which faces away from the locking body, of the fastening body, which bearing body has bearing body ends which extend away from the fastening body in opposite directions, preferably parallelly to one another, and define or include a or the transverse axle at or on which the securing element is mounted to be pivotable about the transverse axis. As a result, it can be achieved in simple mode and manner that the securing element is captively connected with the fastening body, in particular, is easily and reliably pivotable.

According to a development it can be provided that formed at the plate-shaped section of the metal sheet of the securing element at its second securing element end associated with the securing body are two fastening and bearing straps which are bent over from the plate-shaped section of the metal sheet and of which each fastening and bearing strap engages around a bearing body end of the bearing body ends so that the securing element is captively connected by way of the bearing body ends with the fastening body and is pivotable about the transverse axis of the bearing body ends. Consequently, the aforesaid advantages can be realised in a special way.

The securing element locking unit can be a securing lever locking unit and/or a securing flap locking unit. The securing element can be a securing lever and/or a securing flap. The securing element can consist of steel, particularly of galvanised steel or of forged steel.

According to a preferred development it can be provided that the support body of the anti-lift-out and support body as considered in a direction perpendicular to the anti-lift-out securing body longitudinal axis is arranged in the region or in the transverse centre of the anti-lift-out body and extends transversely or perpendicularly away from the anti-lift-out body. The displaceability, the spectrum of use and the flexibility of assembly can thereby be further improved.

According to a development it can be provided that the anti-lift-out body of the anti-lift-out and securing body is constructed as an anti-lift-out plate or anti-lift-out metal sheet and/or that the support body of the anti-lift-out and support body is constructed as a support plate or as a support metal sheet. As a result, particularly advantageous space and stability relationships can be achieved with reduced costs.

According to a particularly preferred development it can be provided that the anti-lift-out and support body has a T profile cross-section in a notional plane perpendicular to the anti-lift-out body longitudinal axis or that the anti-lift-out and support body is designed as a T profile formed from the anti-lift-out body and the support body or with a T profile formed from the anti-lift-out body and the support body and/or that the anti-lift-out and support body as considered in the direction of the anti-lift-out body longitudinal axis has a respective T profile cross-section, at least at those places at which the support body and the anti-lift-out body are connected together, in a notional plane perpendicular to the anti-lift-out body longitudinal axis. The aforesaid advantages can thereby be further enhanced.

According to a preferred development it can be provided that the anti-lift-out and support body is constructed symmetrically with respect to a longitudinal centre plane containing the anti-lift-out body longitudinal axis. The displaceability, spectrum of use and the flexibility of assembly can thereby be further improved and at the same time even more advantageous space and stability relationships can be achieved with further reduced costs.

According to a particularly preferred development it can be provided that the support body end of the support body has a first spacing from an outer surface, which faces away therefrom, of the anti-lift-out body, and the securing body as considered in a direction parallel to the fastening body longitudinal axis has a second spacing—which is greater, preferably only slightly, than the first spacing—from locking surfaces, which are opposite the securing body, of the locking body. As a result, the anti-lift-out and support body is displaceable along the U-section beam when this is permitted by the fastening device.

According to a preferred development it can be provided that the anti-lift-out and support body comprises a plurality of support bodies, which are respectively fixedly or rigidly connected with the anti-lift-out body and respectively extend transversely or perpendicularly away from the anti-lift-out body and which as considered in a direction parallel to the anti-lift-out body longitudinal axis are aligned with one another and as considered in the direction of the anti-lift-out body longitudinal axis have a or a respective mutual support body spacing preferably of the same size. Further advantageous possibilities for displacement, which is free of jamming, of the locking body of the anti-lift-out device and consequently of the anti-lift-out device along the U-section beam are thereby provided and at the same time weight can be saved.

In that case, according to a preferred development it can be provided that the support body respectively extends transversely or perpendicularly away from the anti-lift-out body up to a support body end of the respective support body and is supported by its respective support body end on the transverse wall or on the base groove of the guide groove of the transverse wall of the U-section beam.

According to a development it can be provided that as considered in the direction of the anti-lift-out body longitudinal axis the or each support body spacing corresponds, in particular substantially or approximately, with a maximum length of the or each passage opening. The aforesaid advantages can thereby be further improved.

According to an advantageous development it can be provided that the support limbs of the U profile as considered in a direction perpendicular to the longitudinal centre plane thereof have a mutual support limb spacing and that the anti-lift-out body as considered in a direction perpendicular to the longitudinal centre plane 60 of the anti-lift-out and support body has a maximum anti-lift-out body width which is smaller than the support limb spacing of the support limbs. As a result, accessory parts such as one or more suspension shoes for supporting or suspending the U-section beam and/or one or more post adaptors for connection of one or more scaffolding posts to the U-section beam to the U-section beam can be fastened without problems to the U-section beam, notwithstanding the mounted anti-lift-out device, in length regions where no suspension hooks are arranged.

According to a development it can be provided that the anti-lift-out and support body is formed as an elongate rail extending in the direction of the anti-lift-out body longitudinal axis. Consequently, as considered in the direction of the U-section beam longitudinal axis several mutually adjacent scaffolding floors can be secured particularly simply and securely by means of one and the same anti-lift-out and support body against lifting of the suspension hooks thereof out of the U profile.

According to a particularly preferred development it can be provided that the anti-lift-out and support body is secured by means of a first fastening device and by means of a second fastening device to the U-section beam against lifting of the suspension hook or the suspension hooks of the at least one scaffolding floor out of the U profile of the U-section beam, wherein the first fastening device and the second fastening device as considered in the direction of the U-section beam longitudinal axis of the U-section beam are arranged at a mutual spacing, and the first fastening device is the clamping-fast device and the second fastening device is the quick-action locking device or the first fastening device is the clamping-fast device and the second fastening device is a corresponding or the same clamping-fast device or the first device is the quick-action locking device and the second fastening device is a corresponding or the same quick-action locking device, and the anti-lift-out body has a number—which corresponds with the number of fastening devices—of passage openings which are each formed in a such a way that the respective locking body together with a fastening body part of the respective fastening body is insertable in the direction of the fastening body longitudinal axis thereof as well as perpendicularly to the longitudinal axis of the fastening groove through the respective passage opening. By virtue of these measures, particularly flexible possibilities for securing the anti-lift-out device to the U-section beam can be achieved, whereby assembly flexibility can be still further improved.

It will be obvious that the aforesaid measures can be combined with one another as desired within the scope of feasibility.

Further aspects, features and advantages of the invention can be inferred from the following description part in which preferred embodiments of the invention are described on the basis of the drawings, in which.

Figure 5:
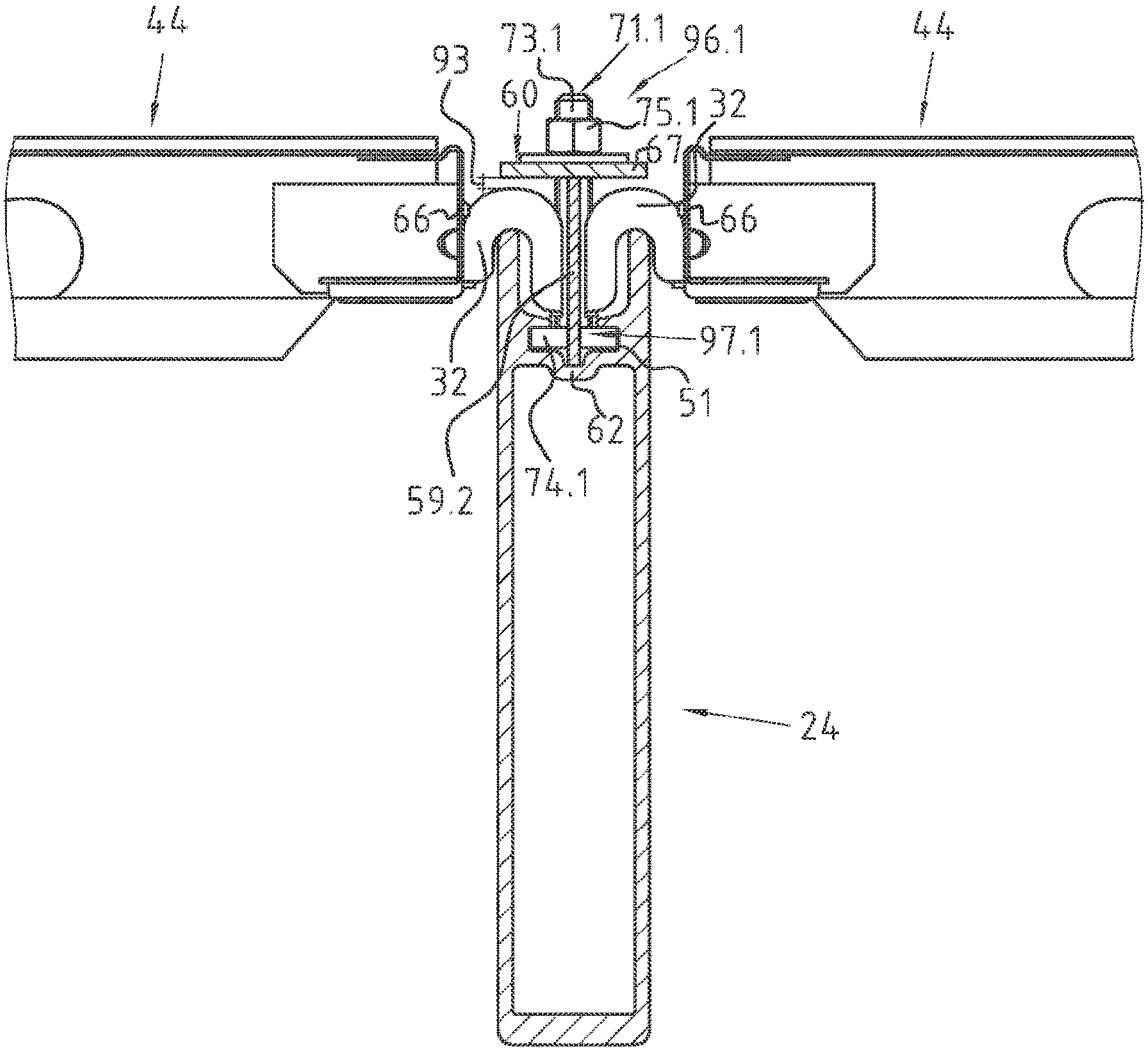
Figure 6:
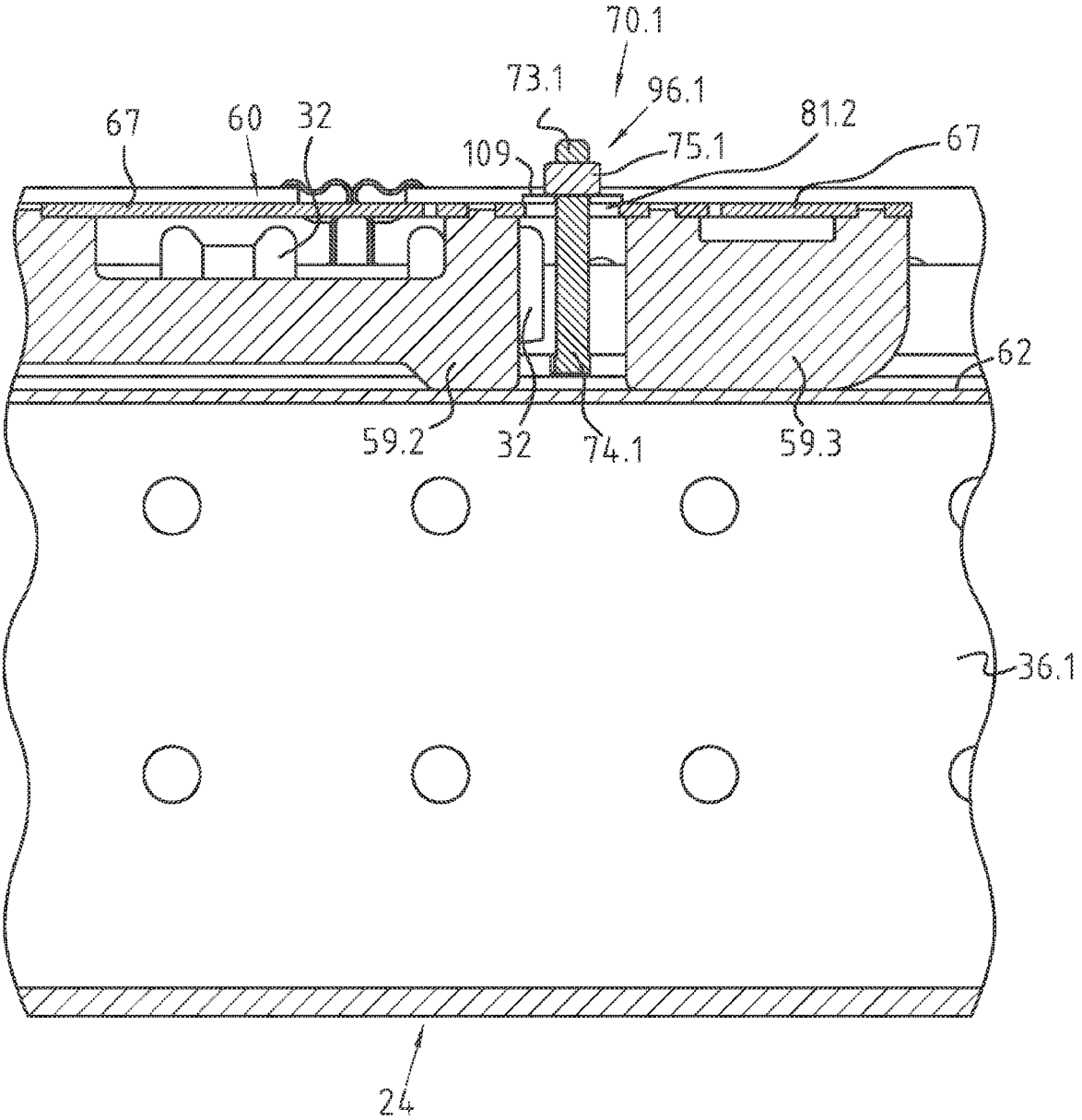
Figure 7:
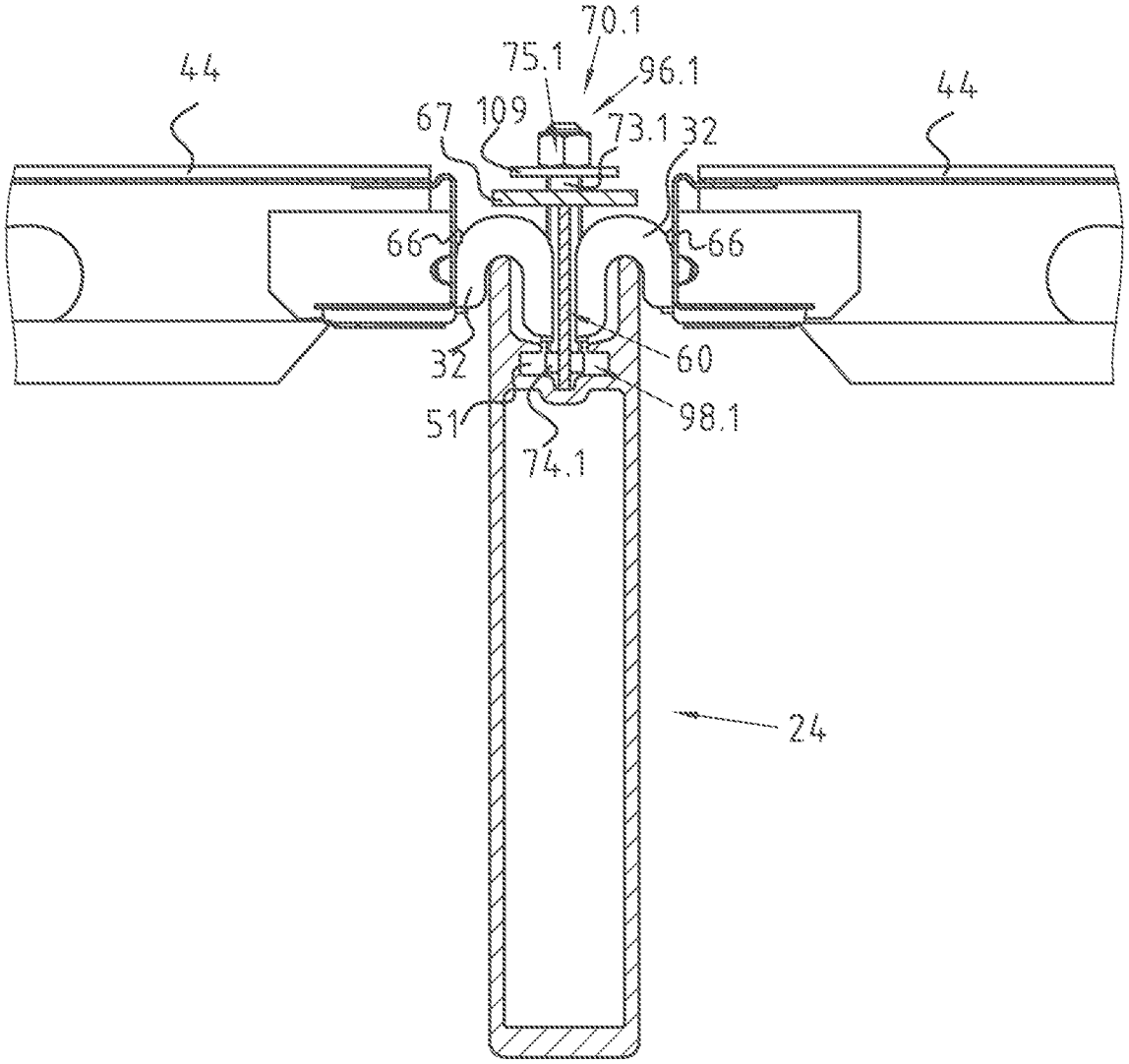
Figure 8:
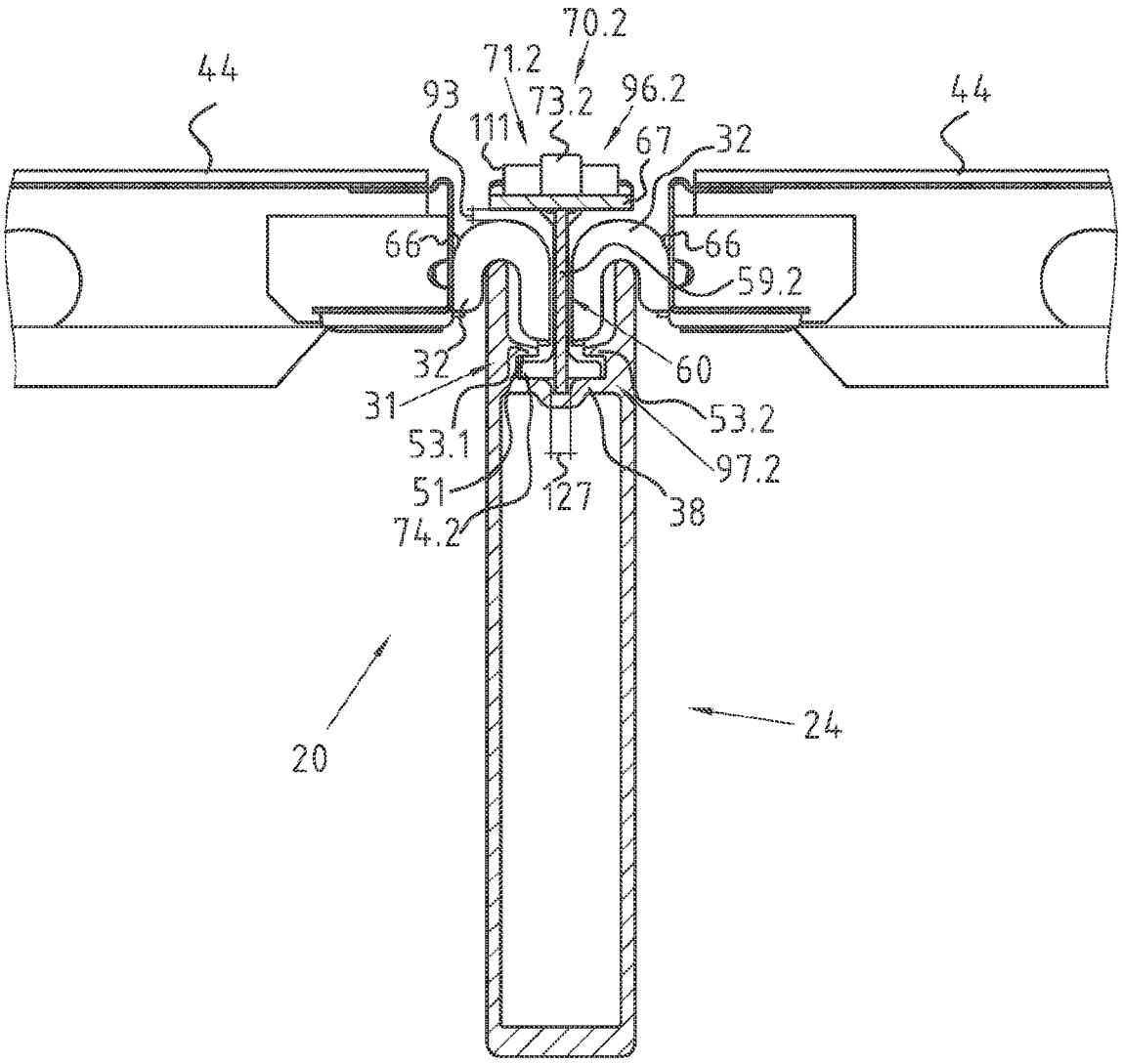
Figure 9:
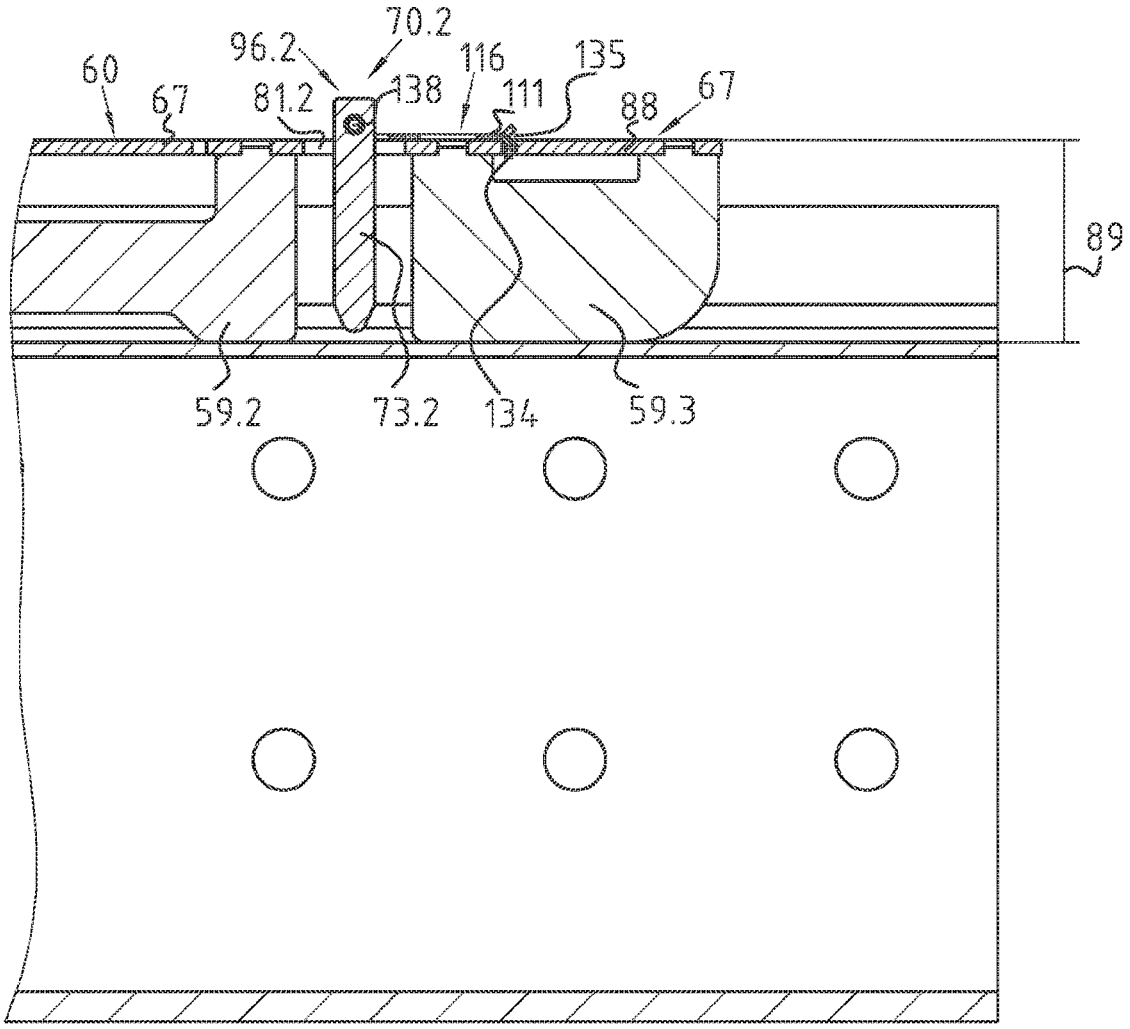
Figure 10:
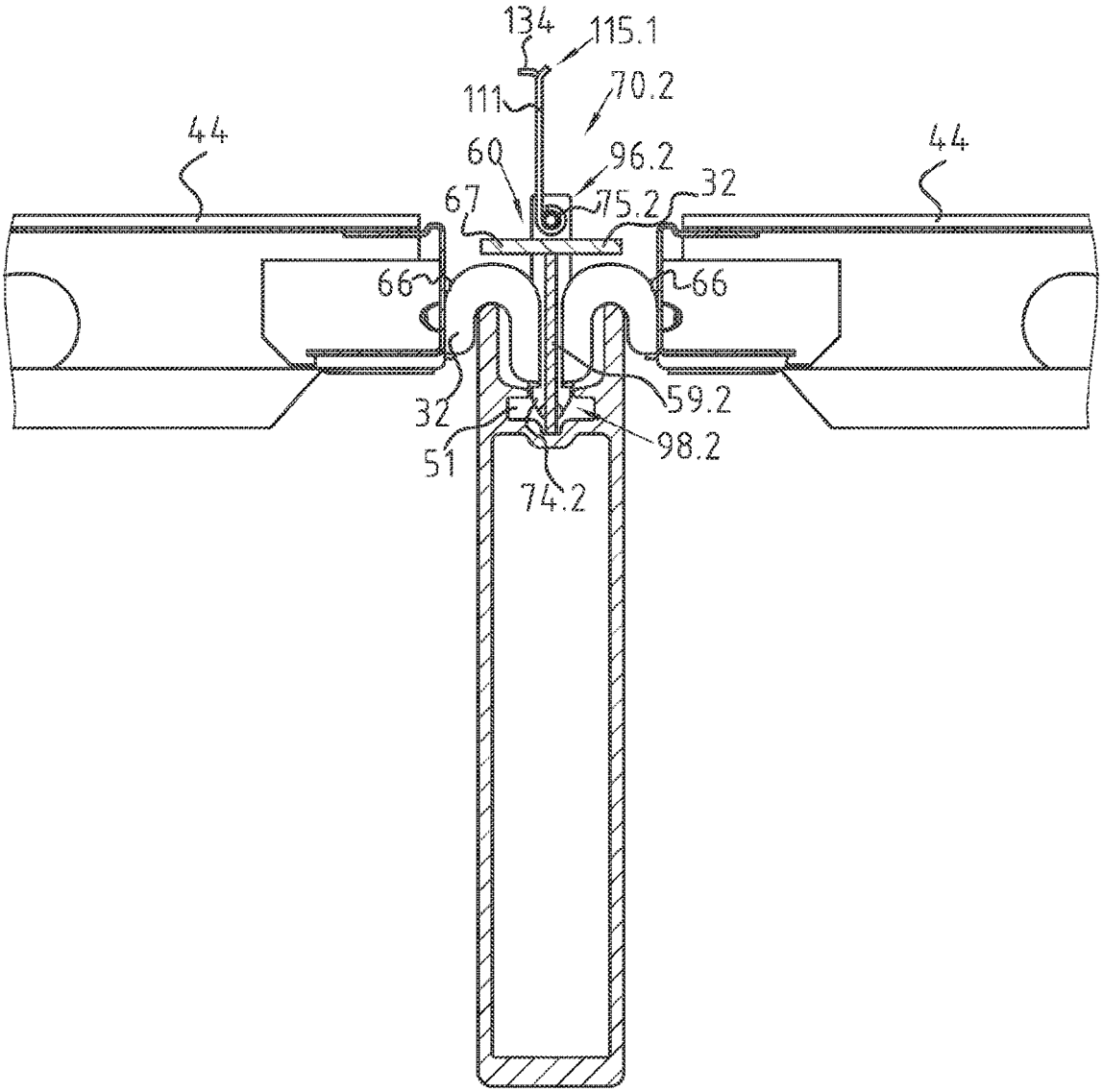
Figure 11:
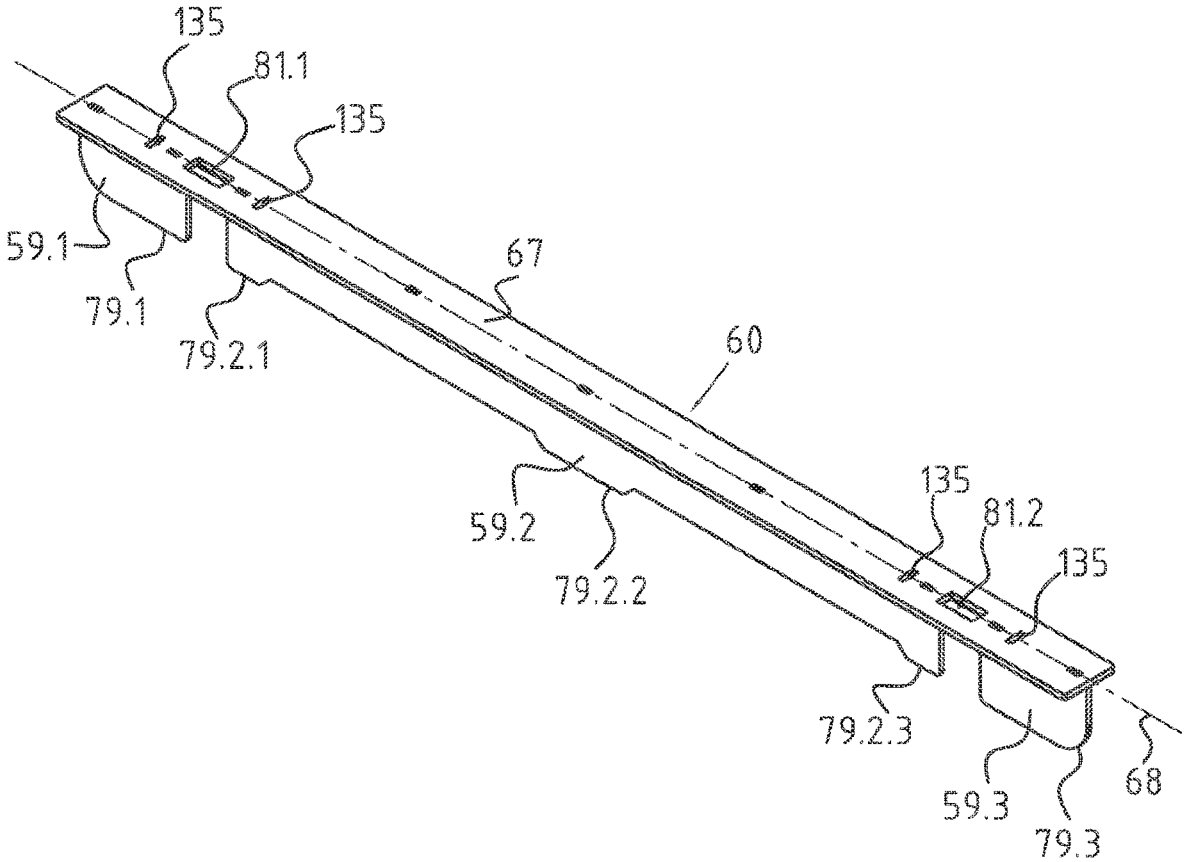
Figure 13:
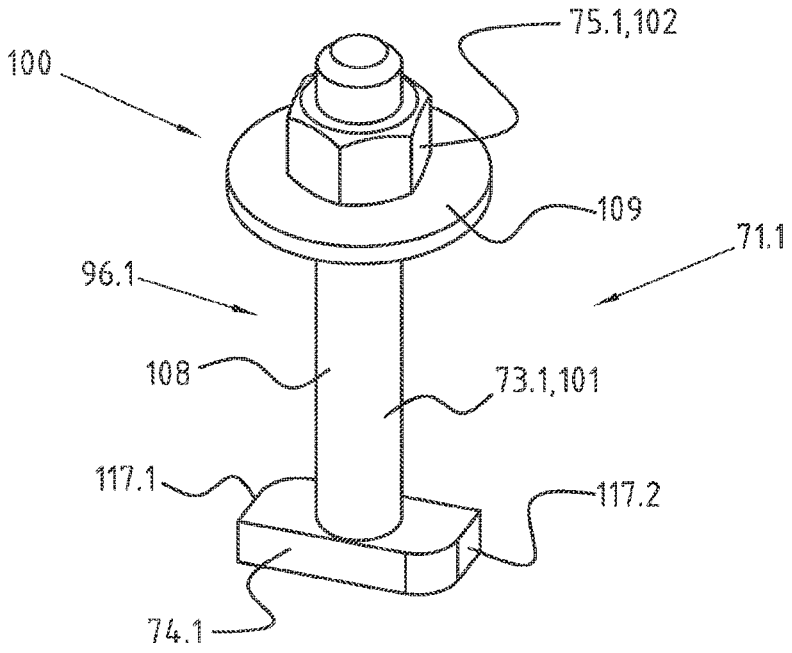
Figure 15:
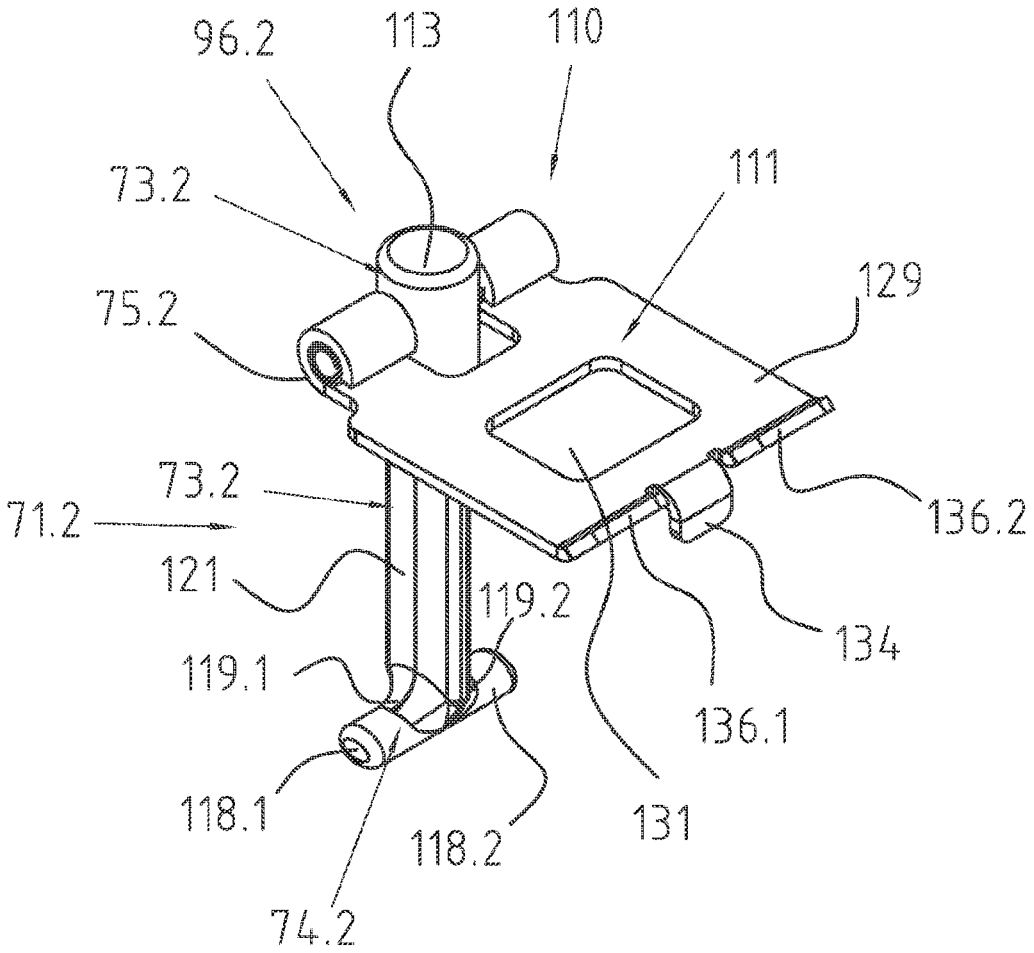
Figure 17:
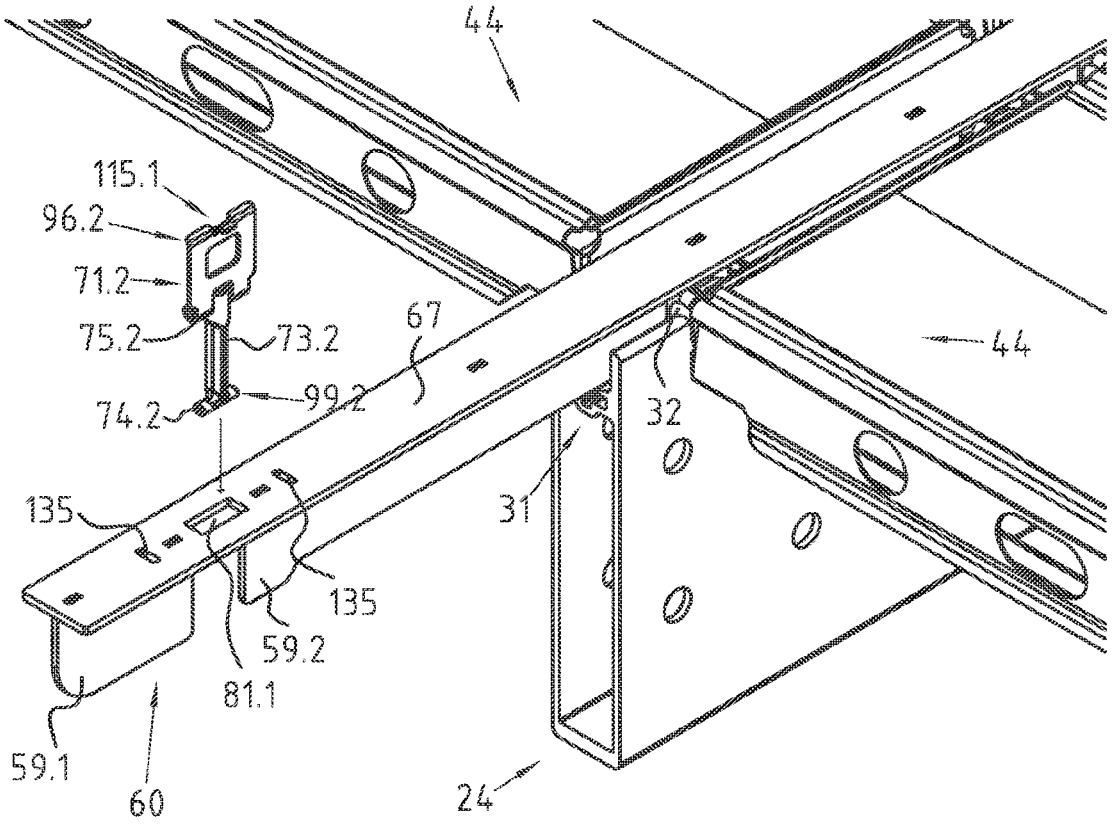
Figure 18:
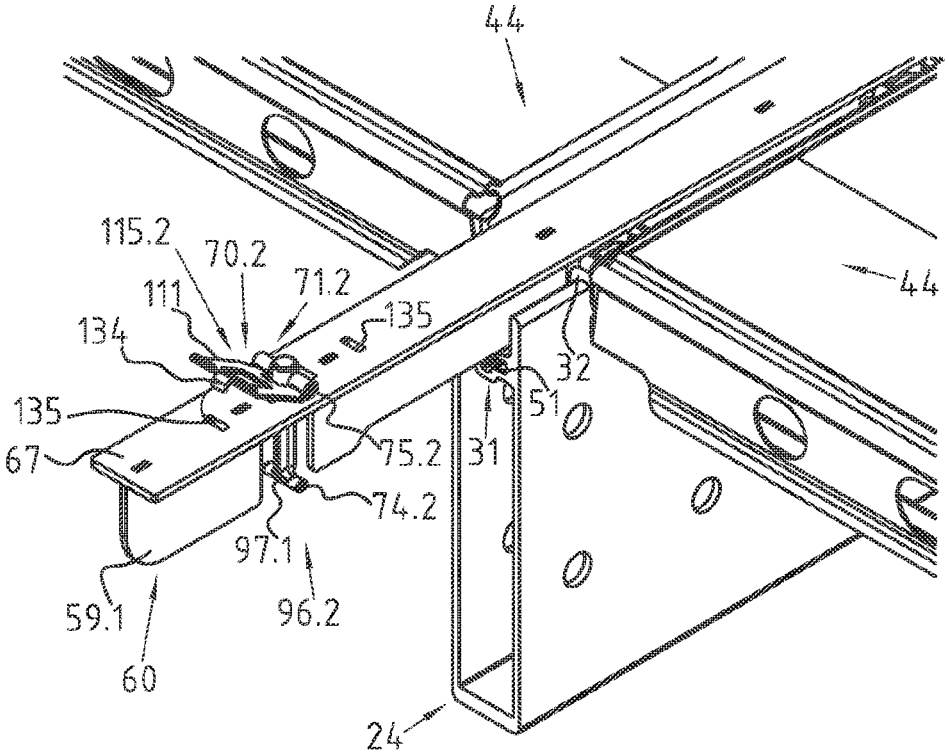
Figure 19:
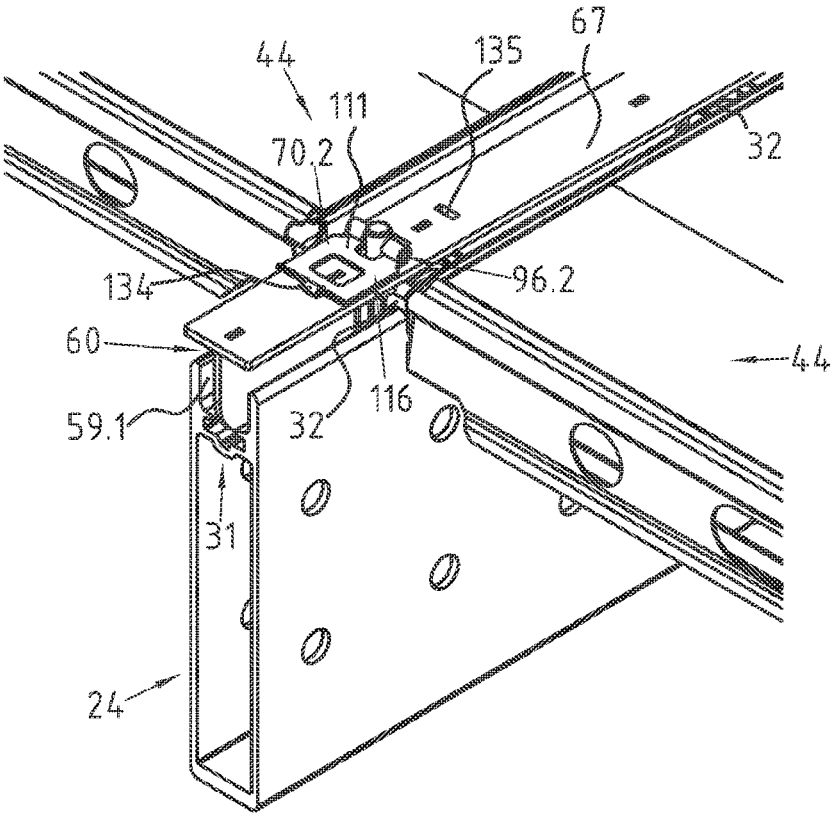

FIG. 5 shows an arrangement of scaffolding components with illustration of the cross-section of the U-section beam, in the U profile of which for illustrative reasons two scaffolding floors are suspended, wherein the suspension hooks thereof are secured by means of an anti-lift-out device according to the invention against lifting out, which in accordance with a first alternative solution includes a fastening device formed as a clamping-fast device;

FIG. 6 shows the arrangement according to FIG. 5 in a view, which is turned relative thereto through 90 degrees, in a longitudinal section;

FIG. 7 shows a cross-sectional view according to FIG. 5 with detached screw connection;

FIG. 8 shows an arrangement of scaffolding components with illustration of the cross section of the U-section beam, in the U profile of which for illustrative reasons again two scaffolding floors are suspended, wherein the suspension hooks thereof are secured by means of an anti-lift-out device according to the invention against lifting out, which in accordance with second alternative solution includes a fastening device, which is formed as a quick-action locking device, with a securing flap disposed in its securing setting;

FIG. 9 shows the arrangement according to FIG. 8 in a view, which is turned relative thereto through 90 degrees, in a longitudinal section;

FIG. 10 shows a cross-section view according to FIG. 8, wherein the securing flap is now disposed in an upwardly pivoted manipulation setting and wherein the locking body is disposed in an unlocking setting;

FIG. 11 shows a perspective illustration of an anti-lift-out and support body according to the invention of the anti-lift-out device according to the invention;

FIG. 12.1 shows a cross-section of the anti-lift-out and support body according to FIG. 11;

FIG. 12.2 shows a side view of the anti-lift-out and support body according to FIG. 11;

FIG. 12.3 shows a plan view of the anti-lift-out and support body according to FIG. 11;

FIG. 13 shows a perspective illustration of the fastening device configured as a clamping-fast device FIG. 14.1 shows a cross-section of the clamping-fast device according to FIG. 13;

FIG. 14.2 shows a side view of the clamping-fast device according to FIG. 13;

FIG. 14.3 shows a plan view of the clamping-fast device according to FIG. 13;

FIG. 15 shows a perspective illustration of the fastening device configured as a quick-action locking device;

FIG. 16.1 shows a cross-section of the quick-action locking device according to FIG. 15;

FIG. 16.2 shows a side view of the quick-action locking device according to FIG. 15;

FIG. 16.3 shows a plan view of the quick-action locking device according to FIG. 15;

FIG. 17 shows a perspective part view in the region of an end-face end of the U-section beam with illustration of a method step relating to assembly of the quick-action locking device for forming an arrangement according to FIGS. 8 to 10, wherein the anti-lift-out and support body for illustrative reasons protrudes partly beyond the end-face end of the U-section beam;

FIG. 18 shows a perspective view according to FIG. 17, wherein now the quick-action locking device has been transferred to an assembly setting in which a locking and thus anti-lift-out securing by means of its locking body is made possible and in which the securing flap is pivoted from its manipulation setting shown in FIG. 17 in the direction of its securing setting shown in FIGS. 9 and 19; and FIG. 19 shows a perspective view according to FIGS. 17 and 18, wherein now the anti-lift-out and support body is illustrated in an intended installation setting and the securing flap is now pivoted into its securing setting.

Figure 1:
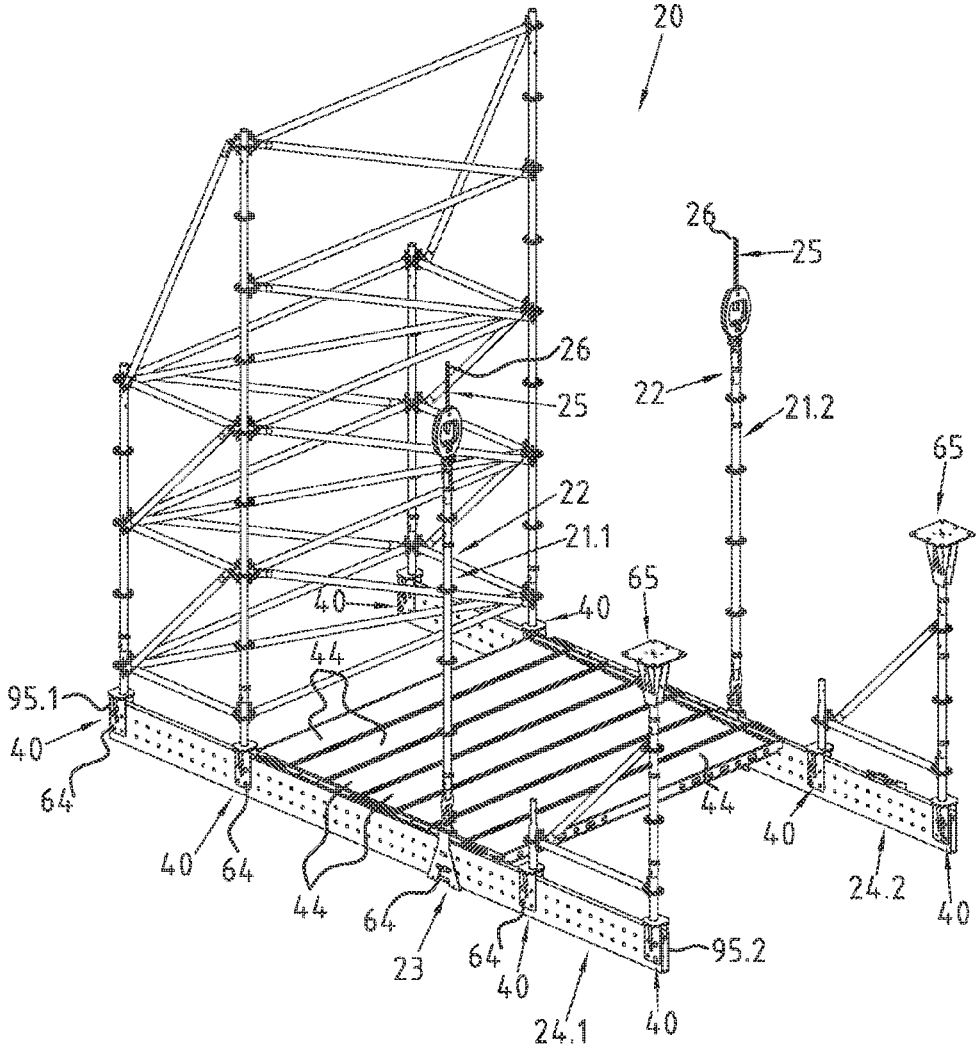
FIG. 1 shows a hanging scaffolding with two U-section beams with outwardly and upwardly open U profiles in which suspension hooks of scaffolding floors are suspended, which are secured by means of anti-lift-out devices according to the invention against lifting out of the respective U profile.
Figure 2:
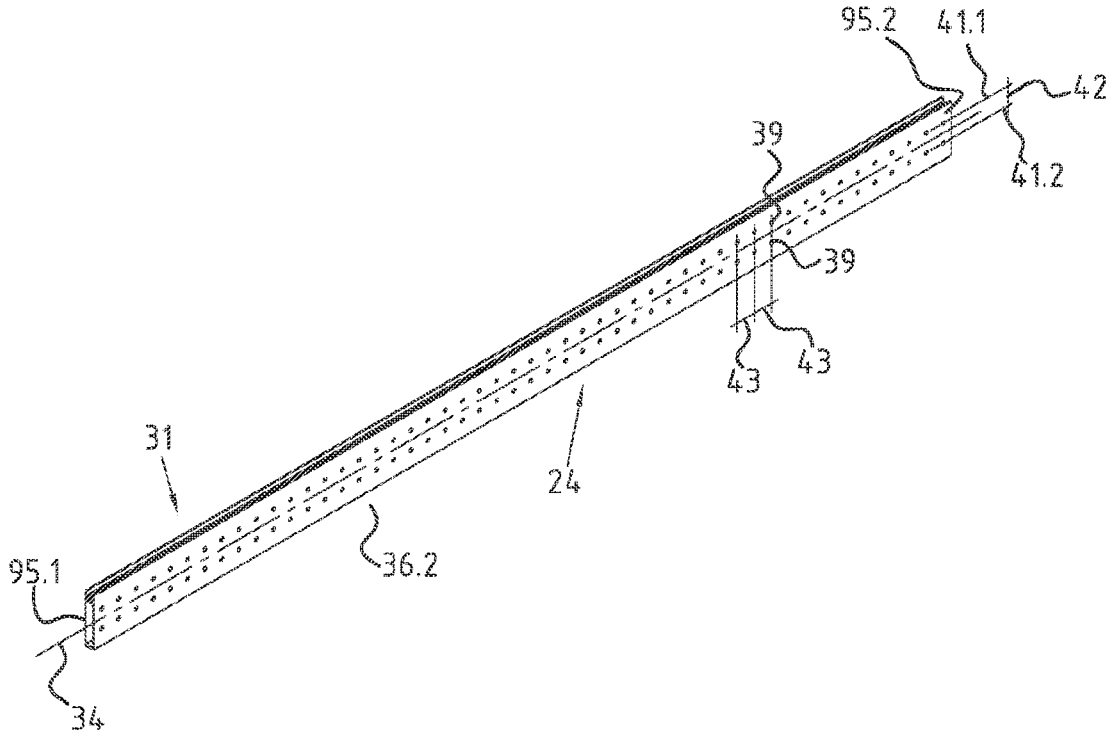
FIG. 2 shows a perspective view of a U-section beam of the two U-section beams shown in FIG. 1.
Figure 3:
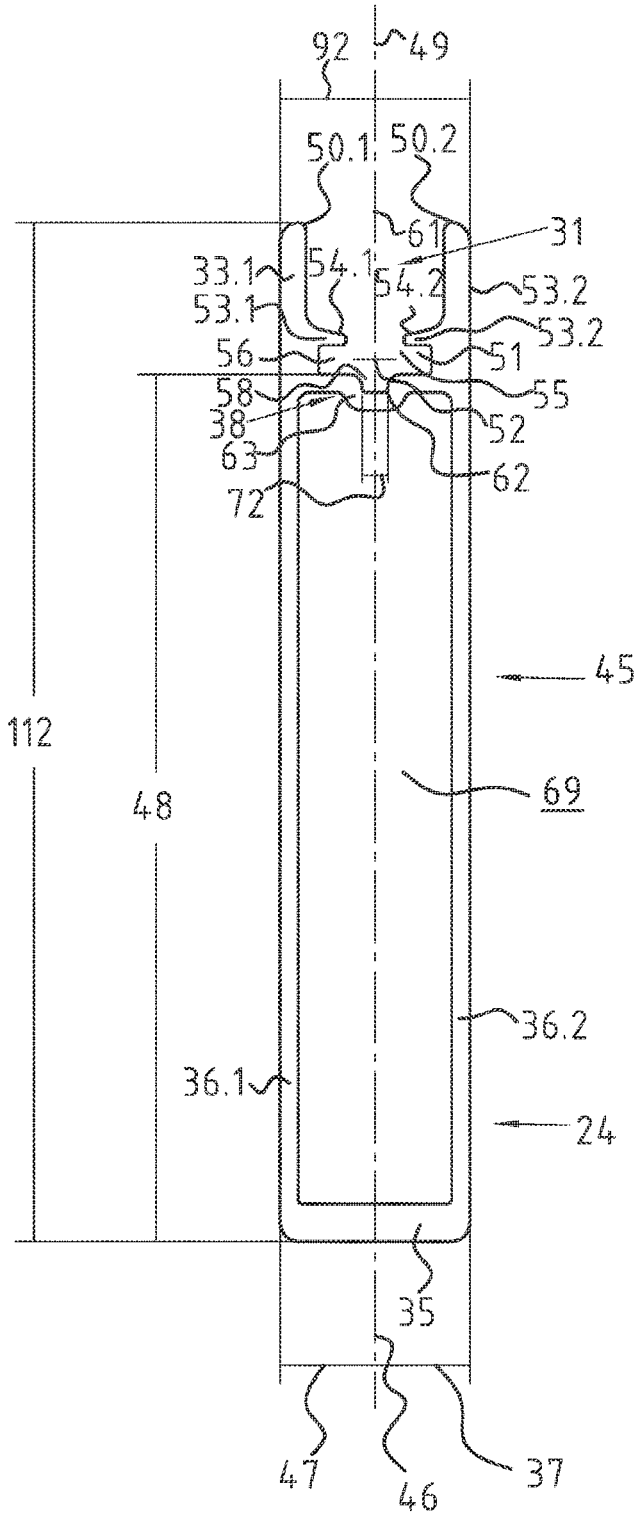
FIG. 3 shows a cross-section of the U-section beam according to FIG. 2.
Figure 4:
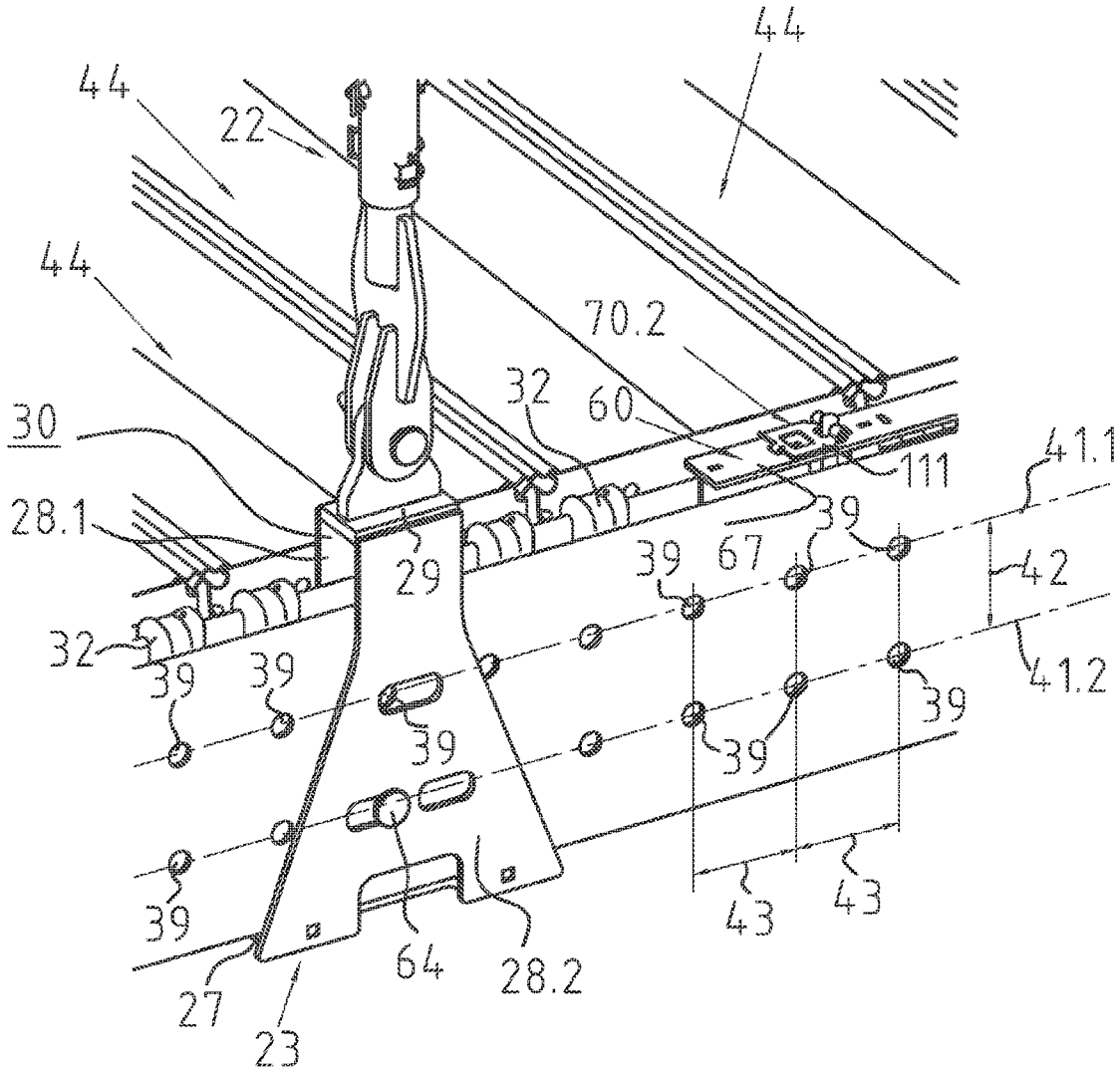
FIG. 4 shows a perspective part view of the hanging scaffolding in the region of the suspension, which is illustrated at the front right in FIG. 1, with a suspension shoe, through which one of the U-section beams extends.

FIG. 1 shows scaffolding 20, which can be hung as hanging scaffolding at constructions (not shown), for example at a bridge (not shown). For this purpose, at least two hanging devices 21.1, 21.2 are provided. Each hanging device 21.1, 21.2 comprises a support device 22, which is preferably to be arranged vertically, and a fastening device 23, which is detachably fastened thereto, for detachable fastening of a respective U-section beam 24.1, 24.2. In the illustrated embodiment the two U-section beams 24.1, 24.2 are of the same configuration. Accordingly, the reference number 24 is used uniformly in the following for U-section beams. The fastening device 23 is a suspension shoe (see also FIG. 3). Each support device 22 comprises a threaded rod 25, which is to be detachably fastened to the construction (not shown) by its upper threaded rod end 26 facing away from the suspension shoe 23. A similar support device has become known from DE 10 2016 103 224 A1. Each suspension shoe 23 comprises a plurality of metal plates, which are preferably welded together and, in particular, a support plate 27 for the laying-on of the associated U-section beam 24.1, 24.2, a first trapezium-shaped side plate 28.1 for lateral support of the associated U-section beam 24 and a second trapezium-shaped side plate 28.2 for lateral support of the associated U-section beam 24, which are respectively fastened in the region of their wider trapezium side thereof to the support plate 27 and which respectively extend perpendicularly thereto and parallelly away from one another, as well as a support plate 29, which is respectively fastened to the two trapezium-shaped side plates 28.1, 28.2 in the region of the narrow trapezium side thereof. The support plate 27, the two side plates 28.1, 28.2 and the support plate 29 include a receiving space 30, which is rectangular in cross-section, for releasable reception of the associated U-section beam 24. Each U-section beam 24 is supported on the support plate 27 of the associated receiving shoe 23. Each U-section beam 24 can, for positioning, be displaced relative to the associated suspension shoe 23 as long as the latter is not yet fastened to the associated U-section beam 24 by way of fastening means.

Two U-section beams 24 which extend parallelly and at a transverse spacing from one another are shown in FIG. 1. Each U-section beam 24 is a beam of aluminium produced in an extrusion method. This can also be termed extruded aluminium U-section beam. Each U-section beam 24 extends as an elongate profile member rectilinearly in a direction parallel to the U-section beam longitudinal axis 34 thereof. In the illustrated embodiment, the two U-section beams 24 have the same U-section beam length of, for example, approximately 4 metres or approximately 5 metres or approximately 6 metres or approximately 7 metres. However, it will be understood that the U-section beam can also have a different U-section beam length. In particular, each U-section beam 24 has the same cross-section in a notional section plane perpendicular to the U-section beam longitudinal axis 34 thereof (see FIG. 3). The U-section beams 24 can be connected by means of longitudinal connectors (not shown) with one or more further corresponding U-section beams (similarly not shown) so as to achieve a desired or necessary span width.

Each U-section beam 24 comprises a plate-shaped lower wall 35 and two plate-shaped side walls 36.1, 36.2, which extend perpendicularly away therefrom in the same direction and which extend parallelly to one another at a transverse spacing 37 corresponding with the width of the lower wall 35. The transverse spacing corresponds with the width, which for example is 52 millimetres, of the U-section beam 24. The lower wall 35 and the two side walls 36.1, 36.2 are outer walls of the U-section beam 24. The outer surfaces of the side walls 36.1, 36.2 and of the lower wall 35 are formed to be substantially planar. A transverse wall 38, which extends transversely to the two side walls 36.1, 36.2 therebetween, is formed at a spacing, which is very much larger than the width of the lower wall, from the lower wall 35. Each side wall 36.1, 36.2 is provided with a plurality of preferably circularly round fastening holes 39 for the fastening of the suspension shoe 23 and of further accessory parts, particularly of the connection adapters 40—which are shown in FIG. 1—for detachable connection of further scaffolding components such as scaffolding posts and/or scaffolding rails. The fastening holes 39 are arranged in two parallel longitudinal rows 41.1, 41.2, which are arranged at a height spacing 42 from one another. The fastening holes 39 respectively have, as considered in the direction of the respective longitudinal row 41.1, 41.2, the same hole spacing 43 from one another. The same number of fastening holes 39 is provided in each longitudinal row 41.1, 41.2. For preference, all fastening holes 39 are of the same form.

Each U-section beam 24 comprises a box-shaped, cross-sectionally closed elongate cavity profile member 45 which is substantially rectangular in cross-section and the cavity 69 of which is bounded by the lower wall 35, which bounds a base of the cavity profile member 45, by the two side walls 36.1, 36.2 and by the transverse wall 38. The cavity profile member 45 of each U-section beam 24 has, as considered in a direction perpendicular to the longitudinal centre plane 46 thereof, a cavity profile member width 47 and, perpendicularly to this direction as considered in a notional section plane formed perpendicularly to the longitudinal centre plane 46, a cavity profile member height 48 which is very much larger than the cavity profile member width 47.

Each U-section beam 24 has at its side opposite the lower wall 35 a U profile 31. Each U profile 31 is formed by the respective transverse wall 38 and by two support limbs 33.1, 33.2, which are arranged parallel to one another and parallel to the longitudinal centre plane 49 of the U profile 31. Each side wall 36.1, 36.2 goes over at the outside in alignment into the associated support limb 33.1, 33.2, which prolongs the respective side wall 36.1, 36.2. Each support limb 33.1, 33.2 has an outer surface which is formed to be substantially planar and which is aligned with the outer surface of the associated side wall 36.1, 36.2. Each U-section beam 24 is formed symmetrically with respect to the longitudinal centre plane 46 thereof, which includes the longitudinal centre plane 49 of the respective U profile 31. Each U-section beam has a U-section beam height 112 of, for example, 280 millimetres.

Each U-section beam 24 has a guiding and fastening groove 51, which is bounded by the respective transverse wall 38 and is open in the direction of the support edges 50.1, 50.2 of the support limbs 33.1, 33.2 as well as towards the inner sides thereof and which extends in a transverse direction transversely to the support limbs 33.1, 33.2 and in a longitudinal direction perpendicularly to the transverse direction in the direction of its longitudinal axis 52 parallelly to the U-section beam longitudinal axis 34 of the U-section beam 24. The guiding and fastening groove 51 is bounded by groove engagement-behind webs 53.1, 53.2, which are arranged at the same height along the inner sides of the two support limbs 33.1, 33.2 and which extend out from the support limbs 33.1, 33.2 respectively inwardly towards one another. A longitudinal slot 55 of, for example, 16 millimetres width is formed between the mutually opposite ends 54.1, 54.2 of the groove engagement-behind webs 53.1, 53.2. The groove engagement-behind webs 53.1, 53.2 bound a locking space 56 of the guiding and fastening groove 51, in which a locking body 74.1, 74.2 can be releasably arranged at a plurality of positions along the guiding and fastening groove 51. The guiding and fastening groove 51 and the longitudinal slot 55 extend in the longitudinal direction of the U-section beam 24 parallelly to the U-section beam longitudinal axis 34 thereof continuously over the entire U-section beam length. The U profile 31 of each U-section beam 24 is formed symmetrically with respect to its longitudinal centre plane 46 containing the U-section beam longitudinal axis 34.

The transverse wall 38 of the respective U-section beam 24 has a guide groove 58, which is open towards the locking space 56 of the guiding and fastening groove 51, for at least one support body 59.1, 59.2, 59.3 of an anti-lift-out and support body 60 according to the invention. The guide groove 58 extends in a guide groove longitudinal direction parallel to the longitudinal axis 52 of the guiding and fastening groove 51 continuously over the entire U-section beam length of the U-section beam 24. The guide groove 58 has the same guide groove spacing from the outer surfaces of the U-section beam 24. The longitudinal centre plane 61 of the guide groove 58 coincides with the longitudinal centre plane 49 of the U profile 31. The groove base 62 of the guide groove 58 is bounded by a transverse wall part 63, which extends in the interior of the cavity profile member 45 of the U-section beam 24, of the transverse wall 38.

At each U-section beam 24 auxiliary components such as, for example, the connection adapters 40 for connection and support of scaffolding posts and of scaffolding bars, such as transverse bars, longitudinal bars and diagonals, are selectably releasably fixed to the respective U-section beam 24 by way of fastening means such as bolts 64. These bolts 64 are respectively plugged through two mutually aligned fastening holes 39 of the fastening holes 39 provided in the side walls 36.1, 36.2 of the U-section beam 24 concerned. Scaffolding posts, particularly of modular scaffolding, to which further scaffolding components, particularly longitudinal bars, transverse bars and diagonals, can be directly or indirectly fastened, are releasably fastened to the connector adapters 40, as shown in FIG. 1.

With the object of being flexible for the respective local conditions, particularly with respect to height relationships and inclinations, at least one beam connecting device 65 can be selectably detachably fastened to a or each U-section beam 24. The at least one beam connection device 65 can be selectably connected in accordance with a first alternative, which is shown in FIG. 1, to a scaffolding post with use of a scaffolding tube, which is detachably fastened to the U-section beam 24 by means of at least one connection adapter 40. According to a second alternative (not shown), the support connection device can be selectably detachably fastened directly to the U-section beam. Through selection of the fastening holes 39 for the bolting together, the mounting conditions of the U-section beam 24 can be realised as flexible or as stiff in bending, as well as the height position of the U-section beam 24 varied, although to a smaller extent than in the case of the said first alternative. Thus, beam connection devices 65 for flexible direct or indirect support and/or fastening of the respective U-section beam 24 at or to the construction (not shown) can be selectably fastened, preferably detachably, to the U-section beams 24.

Scaffolding floors 44, which are adjacent to one another at the longitudinal side and extend perpendicularly to the U-section beams 24, are suspended by their suspension hooks 32 in the outwardly and upwardly open U profiles 31 of the U-section beams 24 extending at a transverse spacing parallelly to one another. The suspension hooks 32, which in the embodiment are respectively designed as so-called U-claws, are fastened to the narrow ends 66 of the scaffolding floors 44, preferably by welding. By contrast to so-called O-claws, which are designed and intended for suspension in O profiles such as scaffolding tubes having a round cross-section, U-claws 32 are designed and intended for suspension in U profiles, particularly in the U profiles 31. In the illustrated embodiment, two suspension hooks 32 are arranged at a transverse spacing from one another at each narrow end 66 of each scaffolding floor 44. Each suspension hook 32 as considered in a direction away from the respective walk and work surface of the associated scaffolding floor 44, thus in installation setting, is open downwardly as well as towards its two sides.

It will be obvious that it is also possible for three or more parallel U-section beams 24 to be provided, which can be arranged at a transverse spacing from one another. Then in the U-profile 31 of at least one U-section beam 24—which as considered in transverse direction is arranged to be inwardly disposed between two other parallel U-section beams, thus as considered in transverse direction—further scaffolding floors can be suspended by their suspension hooks 32 in such a way that the suspension hooks 32 of scaffolding floors 44, which extend away from one another transversely or perpendicularly from the inwardly disposed U-section beam 24, rest on two support limbs 33.1, 33.2 of the U profile 31 of this inwardly disposed U-section beam 24, as illustrated in, for example, FIGS. 5, 7, 8 and 10.

At least one suspension hook 32 of the suspension hooks 32 or several or all suspension hooks 32 of the suspension hooks 32 are secured by means of several anti-lift-out devices 70.1, 70.2 according to the invention against lifting out of the respective U profile 31 of the respective U-section beam 24, thus against being unhooked in upward direction. The anti-lift-out devices 70.1, 70.2 are detachably fastened to the U-section beam 24.

Each anti-lift-out device 70.1, 70.2 preferably includes at least two fastening devices 71.1, 71.2 and an anti-lift-out and support body 60. Each fastening device 71.1, 71.2 comprises a fastening body 73.1, 73.2, a locking body 74.1, 74.2 and a securing body 75.1, 75.2. The respective rod-shaped fastening body 73.1, 73.2 extends in the direction of the fastening body longitudinal axis 76.1, 76.2 thereof. Each locking body 74.1, 74.2 extends in the direction of its locking body longitudinal axis 77.1, 77.2 perpendicularly to the fastening body longitudinal axis 76.1, 76.2 of the respective fastening body 73.1, 73.2. Each locking body 74.1, 74.2 is rigidly connected with the associated fastening body 73.1, 73.2. The respective securing body 75.1, 75.2 is arranged at the respective fastening body 73.1, 73.2 at a spacing 78.1, 78.2 from the respective locking body 74.1, 74.2. The securing body 75.2 extends transversely or perpendicularly to the fastening body longitudinal axis 76.2 of the fastening body 73.2.

According to the invention the anti-lift-out body 67 extending in the direction of the anti-lift-out body longitudinal axis 68 thereof is a component of an anti-lift-out and support body 60. The latter is shown particularly in FIGS. 11, 12.1, 12.2 and 12.3. The anti-lift-out and support body 60 extends rectilinearly in a direction parallel to the anti-lift-out body longitudinal axis 68 of its anti-lift-out body 67. The anti-lift-out and support body 60 is formed as an elongate rail. The anti-lift-out and support body 60 comprises at least one, preferably three, support bodies 59.1, 59.2, 59.3, respectively rigidly connected, particularly by welding, with the anti-lift-out body 67. The or each support body 59.1, 59.2, 59.3 extends along the anti-lift-out body 67 parallelly to the anti-lift-out body longitudinal axis 68. The or each support body 59.1, 59.2, 59.3 extends perpendicularly away from the anti-lift-out body 67 or from the anti-lift-out body longitudinal axis 68 thereof up to a or a respective at least one, support body end 79.1, 79.2.1, 79.2.2, 79.2.3, 79.3. As considered in a direction parallel to the anti-lift-out body longitudinal axis 68 the support bodies 59.1, 59.2, 59.3 are in alignment with one another. As considered in the direction of the anti-lift-out body longitudinal axis 68 the support bodies 59.1, 59.2, 59.3 each have a mutual support body spacing 80.1, 80.2 of, for example, 40 millimetres. The anti-lift-out body 67 has two identical, preferably rectangular, passage openings 81.1, 81.2 each for a respective a fastening device 71.1, 71.2 according to the invention for detachable fastening of the anti-lift-out and support body 60 to the U-section beam 24. As considered in the direction of the anti-lift-out body longitudinal axis 68 these passage openings 81.1, 81.2 have a longitudinal spacing from one another. As considered in the direction of the anti-lift-out body longitudinal axis 68 each support body spacing 80.1, 80.2 corresponds with a maximum length of the respective passage opening 81.1, 81.2 of the anti-lift-out body 67. Each support body 59.1, 59.2, 59.3 is supported by its support body end or by its support body ends 79.1, 79.2.1, 79.2.2, 79.2.3, 79.3 on the groove base 62 of the guide groove 58 of the transverse wall 38 of the U-section beam 24. Each support body end 79.1, 79.2.1, 79.2.2, 79.2.3, 79.3 of the respective support body 59.1, 59.2, 59.3 or each support body 59.1, 59.2, 59.3 has a maximum width 57 which is slightly smaller than a minimum guide groove width 72 of the guide groove 58 of the transverse wall 38.

The anti-lift-out and support body 60 supported by the support body ends 79.1, 79.2.1, 79.2.2, 79.2.3, 79.3 of its support body 59.1, 59.2, 59.3 on the groove base 62 of the guide groove 58 of the transverse wall 38 of the U-section beam 24 is so adapted in configuration to the suspension hook or hooks 32, which rests or rest on at least one support edge 50.1, 50.2 of the support edges 50.1, 50.2 of the support limbs 33.1, 33.2 of the U profile 31 of the U section beam 24 or on the support edges 50.1, 50.2 of the support limbs 33.1, 33.2 of the U profile 31 of the U-section beam 24, and to the U profile 31 of the U-section beam 24 that the suspension hook or hooks 32 and consequently the associated scaffolding floor 44 or associated scaffolding floors 44 is or are displaceable relative to the U profile 31 of the U-section beam 24 longitudinally of the U-section beam 24.

The anti-lift-out and support body 60 is formed symmetrically with respect to a notional transverse centre plane 142, which is formed perpendicularly to the anti-lift-out body longitudinal axis 68. The anti-lift-out and support body 60 is formed symmetrically with respect to a longitudinal centre plane 143 containing the anti-lift-out body longitudinal axis 68.

The anti-lift-out and support body 60 has a length of preferably 1 metre. This length corresponds with the anti-lift-out body length of the anti-lift-out body 67. If the scaffolding floors 44 have, for example, a usual width of, for example, 0.32 metres, up to 3 scaffolding floors 44 disposed adjacent to one another at the longitudinal sides can be secured by an anti-lift-out and support body 60, which has a length of approximately 1 metre, against lifting of its suspension hooks out of the U profile 31 of the U-section beam 24. In practice, preferably several of the anti-lift-out and support bodies 6 are mounted directly one behind the other or directly in succession in longitudinal direction on a U-section beam 24. The anti-lift-out body 67 has an anti-lift-out body width 82 of preferably 50 millimetres. The anti-lift-out and support body 60 has a height 83 of preferably approximately 70 millimetres.

Each support body 59.1, 59.2, 59.3 of the anti-lift-out and support body 60 as considered in a direction perpendicular to the anti-lift out body longitudinal axis 68 is arranged in the transverse centre 84 of the anti-lift-out body 67 and extends perpendicularly away from the anti-lift out body 67. Each support body 59.1, 59.2, 59.3 of each anti-lift-out and support body 60 is constructed as a support plate or support metal sheet. Each support body 59.1, 59.2, 59.3 has a support body wall thickness 85 of preferably 4 millimetres. The anti-lift-out body 67 of the anti-lift-out and support body 60 is constructed as an anti-lift-out plate or anti-lift-out metal sheet. The anti-lift-out body 67 has an anti-lift-out body wall thickness 86 of preferably 4 millimetres.

The anti-lift-out and support body 60 consists of preferably galvanised steel. The anti-lift-out and support body 60 as considered in the direction of the anti-lift-out body longitudinal axis 68 has at those places at which the respective support body 59.1, 59.2, 59.3 and the anti-lift-out body 67 are connected together a respective T profile cross-section 87 and, in particular, as considered in each instance in a notional section plane perpendicular to the anti-lift-out body longitudinal axis 68.

Each support body end 79.1, 79.2.1, 79.2.2, 79.2.3, 79.3, which is intended for support on the groove base 62 of the guide groove of the transverse wall 38 of the U-section beam 24, of the respective support body 59.1, 59.2, 59.3 has a first spacing 89 from an outer surface 88, which faces away therefrom, of the anti-lift-out body 67 and the securing body 75.2 as considered in a direction parallel to the fastening body longitudinal axis 76.2 has a second spacing 91, which is only slightly larger than the first spacing 89, from locking surfaces 90.2 opposite thereto of the locking body 74.2.

The anti-lift-out body 67 as considered in a direction perpendicular to the longitudinal centre plane 60 of the anti-lift-out and support body has a maximum anti-lift-out body width 82 and the support limbs 33.1, 33.2 of the U profile 31 as considered in a direction perpendicular to its longitudinal centre plane 49 have a mutual support limb spacing 92 which is larger than the anti-lift-out body width 82. As a result, accessory parts such as the suspension shoes 23 for support or suspension of the U-section beam and the connection adapters 40 notwithstanding the mounted anti-lift-out device 70.1, 70.2 can be fastened without problem to the U-section beam 24 in longitudinal regions at least where no suspension hooks 32 of the scaffolding floor 44 are arranged.

The anti-lift-out and support body 60 as considered in the direction of the U-section beam longitudinal axis 34 can be laid in any longitudinal position on the U-section beam 24, i.e. supported by its support bodies 59.1, 59.2, 59.3 on the groove base 62 of the guide groove 58 of the transverse wall 38 of the U-section beam 24, and secured against lifting out by means of a fastening device 71.1, 71.2 according to the invention or by means of several fastening devices 71.1, 71.2 according to the invention. Notwithstanding the mounted lift-off securing means, mounting of accessory parts is still possible.

In the mounted state, in which the support body ends 79.1, 79.2.1, 79.2.2, 79.2.3, 79.3 of the support bodies 59.1, 59.2, 59.3 of the anti-lift-out and support body 60 are supported on the groove base 62 of the guide groove 58 of the transverse wall 38 of the U-section beam 24, a respective fastening body 73.1, 73.2 of the respective fastening device 71.1, 71.2 is inserted through each passage opening 81.1, 81.2 of the anti-lift-out body 67 of the anti-lift-out and support body 60 and, in particular, is respectively rotatable about its fastening body longitudinal axis 76.1, 76.2 relative to the anti-lift-out body 67. According to the invention each passage opening 81.1, 81.2 of the anti-lift-out body 61 is formed in such a way that the respective locking body 74.1, 74.2 is movable by means of or by way of the associated fastening body 73.1, 73.2 in the direction of the fastening body longitudinal axis 76.1, 76.2 thereof, as well as transversely or perpendicularly to the longitudinal axis 52 of the guiding and fastening groove 51, through the associated passage opening 81.1, 81.2 of the anti-lift-out body 67.

In the mounted state, in which the support body ends 79.1, 79.2.1, 79.2.2, 79.2.3, 79.3 of the support bodies 59.1, 59.2, 59.3 of the anti-lift-out and support body 67 are supported on the groove base 62 of the guide groove 58 of the transverse wall 38 of the U-section beam 24 a displacement gap 93 is formed between the anti-lift-out body 67 of the anti-lift-out and support body 60 and the suspension hook or hooks 32, over which the anti-lift-out body 67 is engaged, of the at least one scaffolding floor 44.

In the secured mounted state, in which the support body ends 79.1, 79.2.1, 79.2.2, 79.2.3, 79.3 of the support bodies 59.1, 59.2, 59.3 of the anti-lift-out and support body 60 are supported on the groove base 62 of the guide groove 58 of the transverse wall 38 of the U-section beam 24 and in which the respective locking body 74.1, 74.2 is in its respective locking setting 97.1, 97.2, each anti-lift-out and support body 60 is secured by means of at least two fastening devices 71.1, 71.2 to the U-section beam 24 against lifting of the suspension hooks 32 of the at least one scaffolding floor 44 or several scaffolding floors 44 out of the U profile 31 of the U-section beam 24. The fastening bodies 73.1, 73.2 of the fastening devices 71.1, 71.2 or the fastening devices 71.1, 71.2 as considered in the direction of the U-section beam longitudinal axis 34 of the U-section beam 24 are arranged at a spacing 94 from one another. The fastening devices 71.1, 71.2 can be of the same or different configuration particularly according to the longitudinal position in which the respective anti-lift-out and support body 60 is to be detachably fastened or is detachably fastened to the U-section beam 24.

Particularly when the relevant anti-lift-out and support body 60 is mounted to lie outwardly on the U-section beam 24, thus in the region of a U-section beam end 95.1, 95.2 of the mutually remote U-section beam ends 95.1, 95.2 of the U-section beam 24, and/or when the relevant anti-lift-out and support body 60 is mounted at a U-section beam end 95.1, 95.2 of the mutually remote U-section beam ends 95.1, 95.2 of the U-section beam 24 of the succeeding anti-lift-out and support body 40, one of the at least two fastening devices 71.1 can be a clamping-fast device 96.1 or the at least two fastening devices 71.1, 71.1 can each be a clamping-fast device 96.1, 96.1, by means of which or by way of which the anti-lift-out and support body 60 is clamped fast, preferably by screw connection, to the U-section beam 24 when the or the respective locking body 74.1, 74.1 is in its locking setting 97.1, 97.1, so that the anti-lift-out and support body 60 cannot be displaced relative to the U-section beam 24 at least longitudinally thereof.

It will be obvious that even when the relevant anti-lift-out and support body 60 is mounted inwardly at the U-section beam 24, thus at least one respective further anti-lift-out and support body 60 is mounted at both ends, which is clamped fast in such a way to the U-section beam 24—either with the help of at least one fastening device 71.1 constructed as a clamping-fast device 96.1 or with the help of at least two fastening devices 71.1, 71.1 each constructed as a respective clamping-fast device 96.1—that the at least one further anti-lift-out and support body 60 is not displaceable relative to the U-section beam 24 longitudinally thereof, at least one of the at least two fastening devices can be configured as a clamping-fast device or the at least two fastening devices can be each configured as a clamping-fast device.

However, when the relevant anti-lift-out and support body 60 is mounted inwardly at the U-section beam 24, it can preferably be provided that at least one of the at least two fastening devices 71.2 is a quick-action locking device 96.2 or the at least two fastening devices 71.2, 71.2 are each a respective quick-action locking device 96.2, by means of which the anti-lift-out and support body 60, when the respective locking body 74.2 of the quick-action locking device 96.2 is in its respective locking setting 97.2, can be displaced along the U-section beam 24 relative thereto. As a result, the anti-lift-out and support body 60 can be positioned particularly flexibly, wherein at the same time it constantly secures the suspension hooks 32, over which its anti-lift-out body 67 is engaged, against lifting out of the U profile 31 of the U-section beam 24.

The or each quick-action locking device 96.2 is distinguished particularly by the fact that by comparison with the clamping-fast device 96.1 a particularly simple and rapid locking or unlocking of the anti-lift-out device 70.2 to or from the U-section beam 24 is possible and a particularly advantageous securing of the suspension hook 322 or of the suspension hooks 32 against lifting out of the U profile 31 can be realised. At the same time, there are equally particularly advantageous possibilities of being able to displace the suspension hook 32 or the suspension hooks 32 and/or the anti-lift-out and support body 60 along the U-section beam 24. This signifies particularly flexible mounting possibilities, particularly with respect to scaffolding components fastenable to or supportable on the U-section beam 24. The securing of the suspension hooks 32 against lifting out functions, in the case of inwardly disposed anti-lift-out and support bodies 60, by means of locking through a rotational movement of the preferably two fastening devices 71.2, which are configured as quick-action locking devices 96.2. If at least one outwardly disposed anti-lift-out and support body 60, which is clamped fast to the U-section beam 24, is directly connected in each instance by means of at least one fastening device 71.1, which is formed as a clamping-fast device 96.1, with one or several inwardly disposed anti-lift-out and support bodies 60 towards the outside, thus as considered in the direction of the two U-section beam ends 95.1, 95.2 of the U-section beam 24, the inwardly disposed anti-lift-out and support body 60 or the inwardly disposed anti-lift out and support bodies 60 do not have to be secured against longitudinal displacement along the U-section beam 24. If the two outwardly disposed anti-lift-out and support bodies 60 are each clamped fast to the U-section beam 24 by means of at least one fastening device 71.1 formed as a clamping-fast device 96.1, the inwardly disposed anti-lift-out and support body 60 directly connected inwardly in longitudinal direction or the inwardly disposed anti-lift-out and support bodies 60 directly connected inwardly in longitudinal direction can no longer be displaced relative to the U-section beam 24 longitudinally thereof. Thus, as securing of each inwardly disposed anti-lift-out and support body 60 against longitudinal displacement it is sufficient if as considered in direction of the U-section beam ends 95.1, 95.2 of the U-section beam 24 a respective anti-lift-out and support body 60 directly connected with the outermost anti-lift-out and support body 60 is clamped fast to the U-section beam 24 by means of at least one fastening device 71.1 formed as a clamping-fast device 96.1.

A clamping-fast device 96.1 according to the invention is shown in, in particular, FIGS. 13, 14.1, 14.2 and 14.3. The clamping-fast device 96.1 comprises a screw-and-nut locking unit 100, in which a screw 101 and a nut 102 are screwed together. The fastening body 73.1 of the clamping-fast device 96.1 is a first threaded body, here a screw 101, with a first thread 103, which is screwed together with a second thread 104 of the securing body 75.1 constructed as a second threaded body, here the nut. In the mounted and secured state, the anti-lift-out and support body 60 is detachably screw-connected by means of the screw-and-nut locking unit 100 of the clamping-fast device 96.1 to the U-section beam 24 in such a way that the anti-lift-out and support body 60 is not displaceable at least relative to the U-section beam 24 in the direction of the U-section beam longitudinal axis 34 thereof or along the U-section beam 24. The fastening body 73.1 of the clamping-fast device 96.1 is rigidly connected with the locking body 74.1, which is configured as a groove block or hammer head. This locking body 74.1 is comparatively strongly radiused at two diametrically opposite vertical edges 105.1, 105.3, whereas the two other diametrically opposite vertical edges 105.2, 105.4 are not radiused or not radiused in the relevant manner. As a result, on the one hand rotation of this locking body 74.1 about the fastening body longitudinal axis 76.1 in the guiding and fastening groove 51 of the U-section beam 24 from its locking setting 97.1 into an unlocking setting 98.1 is possible and on the other hand the angle of rotation can be limited by bearing of the two other vertical edges 105.2, 105.4 of this locking body 74.1 against the groove walls of the guiding and fastening groove 51 in the locking setting 97.1, corresponding with rotation through approximately 90 degrees. The locking body 74.1 of the clamping-fast device 96.1 has a locking body width 106.1 and a locking body length 107.1 which are very much larger than the locking body width 106.1. The locking body 74.1 of the clamping-fast device 96.1 extends along its locking body longitudinal axis 77.1. It has two mutually remote locking body ends 117.1, 117.2 by which it extends perpendicularly to the fastening body longitudinal axis 76.1 of the fastening body 73.1 in opposite directions away therefrom. The fastening body 73.1 of the clamping-fast device 96.1 is a cylinder screw 101 which has an external thread 103 at least in the region of its screw end facing away from the locking body 74.1. The securing body 75.1, which is formed as a hexagonal nut, is screwed by its internal thread 104 onto the external thread 103. A washer 109 is received on the shank 108 of the screw 101 between the locking body 74.1 and the nut 102. By way of this washer 109 the securing body 75.1, which is constructed as a nut, in the intended mounted state on the U-section beam 24 secures the suspension hook or hooks 32 of one or more scaffolding floors 44 against lifting out of the U profile 31 of the U-section beam 24. The fastening body 73.1 and the locking body 71.1 of the clamping-fast device 96.1 consist of, preferably, galvanised steel. The fastening body 73.1 and the locking body 71.1 of the clamping-fast device 96 are preferably produced from one piece.

A quick-action locking device 96.2 according to the invention is shown in, in particular, FIGS. 15, 16.1, 16.2 and 16.3. The quick-action locking device 96.2 comprises, as securing element locking unit, a securing flap locking unit 110 which as securing element comprises a securing flap 111, which comprises a securing body 112. This securing body 112 extends in a direction parallel to the locking body longitudinal axis 77.2 of the locking body 74.2 of the quick-action locking device 96.2. The securing flap 111 is fastened to a fastening body end 113, which faces away from the locking body 74.2, of the fastening body 73.2 of the quick-action locking device 96.2 to be rotatable about a transverse axis 114, which extends perpendicularly to the fastening body longitudinal axis 73.2 of this fastening body 73.2, starting from a plurality of possible manipulation settings 115.1, 115.2 into a securing setting 116 relative to the anti-lift-out and support body 60. The securing flap 111 is rotatable about the transverse axis 114 through an angle of more than 180 degrees relative to the fastening body longitudinal axis 76.2 of the fastening body 73.2. In the securing setting 116 of the securing flap 111, this and consequently the fastening body 73.2 pivotably fastened thereto and therewith the locking body 74.2 fastened thereto, are secured against unintended rotation about the fastening body longitudinal axis 76.2 from the locking setting 97.2 of this locking body 74.2 into its unlocking setting 98.2, as shown in FIG. 8 and, in particular, in FIG. 9. The securing flap 111 in at least one of its manipulation settings 115.1, 115.2 can serve for manual rotation of the locking body 74.2 of the quick-action locking device 96.2 about the fastening body longitudinal axis 76.2 from its locking setting 97.2 into its unlocking setting 98.2 and vice versa. If the locking body 74.2 is in its unlocking setting 98.2, the securing flap 111 in its at least one manipulation setting 115.1, 115.2 can serve the purpose of manually withdrawing the locking body 74.2 together with the fastening body 73.2 of the quick-action locking device 96.2 from the guiding and fastening groove 51 of the U-section beam 24 and from the associated passage opening 81.1, 81.2 of the associated anti-lift-out body 67. When the locking body 74.2 of the quick-action locking device 96.2 is in its unlocking setting 98.2, which by its orientation corresponds with its insertion setting 99.2, the securing flap 111 in its at least one manipulation setting 115.1, 115.2 can serve for manual insertion and penetration of the locking body 74.2 together with a fastening body part of the fastening body 73.2 of the quick-action locking device 96.2 into and through a passage opening 81.1, 81.2 of the passage openings 81.1, 81.2 of the associated anti-lift-out body 67 as well as for insertion of the locking body 74.2 into the guiding and fastening groove 51 of the U-section beam 24 (see FIGS. 10 and 17). The fastening body 73.2 and the locking body 74.2 of the quick-action locking device 96.2 consist of, preferably forged, steel. For preference, the fastening body 73.2 and the locking body 74.2 of the quick-action locking device 96.2 are produced from one piece.

In the embodiments shown in FIGS. 7, 6 and 19 the anti-lift-out and support body 60 is detachably fastened by means of the quick-action locking device 96.2 to the U-section beam 24 in such a way that the anti-lift-out and support body 60 is displaceable relative to the U-section beam 24 in a displacement direction parallel to the U-section beam longitudinal axis 34 and, in particular, in all pivotation settings in which the securing flap 111 is rotatable relative to the anti-lift-out and support body 60 about the transverse axis 114. The securing body 112 of the quick-action locking device 96.2 and the locking body 74.2 of the quick-action locking device 96.2 as considered in the direction of the fastening body longitudinal axis 76.2 are substantially not movable relative to one another or are not movable relative to one another.

The locking body 74.2, which extends along the locking body longitudinal axis 77.2 thereof, of the quick-action locking device 96.2 is convexly rounded substantially overall or formed to be outwardly curved substantially overall. The locking body 74.2 of the quick-action locking device 96.2 has a locking body width 106.2 and a locking body length 107.1 which is very much larger than the locking body width 106.2. The locking body 74.2 of the quick-action locking device 96.2 extends along the locking body longitudinal axis 77.2 thereof. It has two mutually remote locking body ends 118.1, 118.2, by which it extends perpendicularly to the fastening body longitudinal axis 76.2 of the fastening body 73.2 away therefrom in opposite directions. A concavely rounded or inwardly curved transition region 119.1, 119.2 is formed between each locking body end 118.1, 118.2 of the locking body ends 118.1, 118.2 and the fastening body 73.2 of the quick-action locking device 96.2.

The fastening body 73.2 of the quick-action locking device 96.2 extends along the fastening body longitudinal axis 76.2 thereof. This fastening body 73.2 is formed with a preferably sword-shaped or blade-shaped flat web 121 in a height region 120 formed between the locking body 74.2 of the quick-action locking device 96.2 and the securing body 112 of the quick-action locking device 96.2. The flat web 121 extends by its flat web longitudinal axis 122 parallel to the anti-lift-out body longitudinal axis 68. The flat web 121 has over its entire flat web height 123, as considered in a notional plane perpendicular to the fastening body longitudinal axis 76.2 and in a direction perpendicular to the anti-lift-out body longitudinal axis 68, a maximum thickness 125 and has, in the same notional plane and as considered in a direction parallel to the anti-lift-out body longitudinal axis 68, a maximum width 124 which is very much larger than the maximum thickness 125 of the flat web 121. In the illustrated embodiment the maximum width 124 is more than three times larger than the maximum thickness 125 of the flat web 121. The flat web 121 has, in the said height region 120 over its entire flat web height 123, convexly rounded edges or is formed to be outwardly curved in the said height region 120 over its entire flat web height 123 around its outer circumference. In the said height region 120 the flat web 121 has, over its entire flat web height 123, an elliptical flat-web cross-section in a notional section plane perpendicular to the fastening body longitudinal axis 76.2. The maximum thickness 125 of the flat web 121 in the height region 120 is smaller than a minimum spacing 127 from mutually opposite suspension hooks 32 of two scaffolding floors 44, which are arranged with the narrow end faces 66 opposite and the suspension hooks 32 of which are laid on the support edges 50.1, 50.2 of the support limbs 33.1, 33.2 of the U profile 31 of the U-section beam 24 (see FIG. 8). It is thereby possible to displace the or the respective anti-lift-out device 70.2 by the flat web 121 of its fastening body 73.2 along the U-section beam 24 without collision with the said suspension hooks 32 of the scaffolding floors 44.

The securing flap 111 of the quick-action locking device 96.2 consists of a metal plate 128. The securing flap 111 consists of preferably galvanised steel. However, it can also consist of forged steel. The securing flap 111 has a plate-shaped section 129 for resting on an outer surface 88, which faces away from the support body ends 79.1, 79.2.1, 79.2.2, 79.2.3, 79.3 of the support bodies 59.1, 59.2, 59.3 of the anti-lift-out and support body 60, of the anti-lift-out body 67. A grip opening 131 for the gripping of at least one finger or the gripping of at least two fingers of a hand of an assembler (not shown) is provided in the plate-shaped section 129. The grip opening 131 is bounded at a securing flap end 132.1, which faces away from the securing body 112, by a web 133. The plate-shaped section 129 of the securing flap 111 has an anti-twist body 134 at its securing flap end 132.1 facing away from the securing body 112 of the securing flap. The anti-twist body 134 in the securing setting 116 of the securing flap 111 engages in a securing passage 135 of the anti-lift-out body 67 so that then a securing of the securing flap 111 against unintended rotation of the locking body 74.2 of the quick-action locking device 96.2 is achieved (see FIG. 9). The plate-shaped section 129 of the securing flap 111 has at its first securing flap end 132.1, which faces away from the securing body 112, at least one actuating limb 136.1, 136.2 for manual pivotation of the securing flap 111 from its securing setting 116 into its at least one manipulation setting 115.1, 115.2. The anti-twist body 134 is flanged or bent over from the metal plate 128 in a first direction 137.1. If the securing plate 111 in its securing setting 116 rests on the said outer surface 88 of the anti-lift-out body 67 of the anti-lift-out and support body 60 the anti-twist body 134 extends in the securing passage 135 of the anti-lift-out body 67. The at least one actuating limb 136.1, 136.2 is flanged over or bent over from the metal plate 128 of the securing flap 111 in a second direction 137.2 away from the anti-twist body 134. If the securing plate 111 in its securing setting 116 rests on the said outer surface 88 of the anti-lift-out body 67 of the anti-lift-out and support body 60 the at least one actuating limb 136.1, 136.2 extends obliquely upwardly away from the anti-lift-out body 67.

A bearing body 138 formed as a bearing dowel pin is fastened by clamping in a passage bore of the fastening body 73.2 at the fastening body end 113, which faces away from the locking body 74.2, of the fastening body 72.2 of the quick-action locking device 96.2. The bearing body 138 has two bearing body ends 140.1, 140.2 which extend parallelly to one another in opposite directions away from the fastening body 73.2. The bearing body 138 contains or forms the transverse axis 114 about which the securing flap 111 is mounted to be rotatable. Two fastening and bearing straps 141.1, 141.2 are formed at the plate-shaped section 129 of the metal plate 128 of the securing flap 111 at its second securing flap end 132.2 associated with the securing body 112, which straps are bent around or flanged over from the plate-shaped section 129 of the metal plate 128 and each engage around a respective bearing body end 140.1, 140.2 of the bearing body ends 140.1, 140.2 of the bearing body 138. The securing flap 111, which is rotatable about the transverse axis 114, is thereby captively connected with the fastening body 73.2 of the quick-action locking device 96.2

In FIGS. 5 and 6 there is shown an arrangement of the scaffolding components with illustration of the cross-section of the U-section beam 24, in the U profile 31 of which for reasons of illustration two scaffolding floors 44 are suspended, wherein the suspension hooks 32 thereof are secured by means of a first anti-lift-out device 70.1 according to the invention against lifting out. According to a first alternative solution this first anti-lift-out device 70.1 comprises a clamping-fast device 96.1. The clamping-fast device 96.1 has already been described in the foregoing and is shown in, in particular, FIGS. 13, 14.1, 14.2 and 14.3. In FIG. 5, the locking body 74.1 of the clamping-fast device 96.1 is shown in a locking setting 97.1 in which it engages behind the groove engagement-behind webs 53.1, 53.2 of the guiding and fastening groove 51 of the U-section beam 24 and in which it is detachably fastened in the locking space 56 of the guiding and fastening groove 51. The fastening body 73.1, which is formed as a screw 101, is inserted through a passage opening 81.1 of the anti-lift-out body 67 so as to be rotatable about its fastening body longitudinal axis 76.1 relative to the anti-lift-out body 67. The anti-lift-out and support body 60, which is supported by the support body ends 79.1, 79.2.1, 79.2.2, 79.2.3, 79.3 of its support body 59.1, 59.2, 59.3 on the groove base of the guide groove 58 of the transverse wall 38 of the U-section beam 24, engages over the suspension hooks of the scaffolding floors 44, wherein the anti-lift-out body 67 secures by means of the securing body 75.1, which is formed as a nut, by way of the washer 109, the fastening body 73.1 and the locking body 74.1, thus via the washer 109, the fastening body 73.1 formed as a screw 101 and the locking body 74.1 rigidly fastened thereto, the suspension hooks 32 of the scaffolding floors 44 against lifting upwardly or in a vertical direction or in a direction perpendicular to the U-section beam longitudinal axis 34 out of the U profile 31 of the U-section beam 24.

Starting from the locking setting 97.1 shown in FIG. 5, the locking body 74.1 is rotatable by means of the fastening body 73.1, which is formed as the screw 101, of the clamping-fast device 96.1 about the fastening body longitudinal axis 76.1 into an unlocking setting 98.1, which is shown in FIG. 7. In this unlocking setting 98.1 the locking body 74.1 can be moved, by means of or by way of the fastening body 73.1, which is formed as the screw 101, in a direction perpendicular to the longitudinal axis 52 of the guiding and fastening groove 51 away from the transverse wall 38 of the U-section beam 24 out of the guiding and fastening groove 51 through the longitudinal slot 55.

An arrangement of scaffolding components with illustration of the cross-section of the U-section beam 24, in the U profile 31 of which again for reasons of illustration two scaffolding floors 44 are suspended, is shown in FIGS. 8 and 9, wherein the suspension hooks 32 thereof are secured by means of a second anti-lift-out device 70.2 according to the invention against lifting out. This second anti-lift-out device 70.2 according to a second alternative solution comprises a quick-action locking device 96.2. The quick-action locking device 96.2 has already been described in the foregoing and is shown in, in particular, FIGS. 15, 16.1, 16.2 and 16.3. The locking body 74.2 of the quick-action locking device 96.2 is shown in FIG. 8 in a locking setting 97.2 in which it engages behind the groove engagement-behind webs 53.1, 53.2 of the guiding and fastening groove 51 of the U-section beam 24 and in which it is detachably fastened in the locking space 56 of the guiding and fastening groove 51. The fastening body 73.2 formed with the flat web 121 is inserted through a passage opening 81.1 of the anti-lift-out body 67 so as to be rotatable about its fastening body longitudinal axis 76.2 relative to the anti-lift-out body 67. The anti-lift-out body 67, which is supported by the support body ends 79.1, 79.2.1, 79.2.2, 79.2.3, 79.3 of its support body 59.1, 59.2, 59.3 on the groove base of the guide groove 58 of the transverse wall 38 of the U-section beam 24, of the anti-lift-out and support body 60 here, too, engages over the suspension hooks 32 of the scaffolding floors 44, wherein the anti-lift-out body 67 secures by means of the securing body 75.2 of the securing flap 111 by way of the fastening body 73.2 and the locking body 74.2, thus via the fastening body 73.2 formed with the flat web 121 and via the locking body 74.2 rigidly fastened thereto, the suspension hooks 32 of the scaffolding floors 44 against lifting upwardly or in a vertical direction or in a direction perpendicular to the U-section beam longitudinal axis 34 out of the U profile 31 of the U-section beam 24.

Starting from the locking setting 97.2 shown in FIG. 8 the locking body 74.2 is rotatable by means of the fastening body 73.2, which is formed with the flat web 121, of the quick-action locking device 96.2 about the fastening body locking axis 76.2 into an unlocking setting 98.2, which is shown in FIG. 10. In this unlocking setting 98.2 the locking body 74.2 can be moved by means of or by way of the fastening body 73.2, which is formed with the flat web 121, in a direction perpendicular to the longitudinal axis 52 of the guiding and fastening groove 51 away from the transverse wall 38 of the U-section beam 24 out of the fastening and guiding groove 51 through the longitudinal slot 55.

A method for securing several scaffolding floors 44 of scaffolding 20, which is preferably able to be hung or is hung as hanging scaffolding, against lifting of the suspension hooks 32, which are arranged at its narrow end faces 66, out of the U profile 31 of the U-section beam 24 is described in the following on the basis of FIGS. 17 to 19 and with reference to FIGS. 7 to 9, wherein a fastening device 71.2 configured as a quick-action locking device 96.2 is used. The quick-action locking device 96.2 has already been described in the foregoing and is shown in FIGS. 15, 16.1, 16.2 and 16.3.

If it is has not taken place, initially the scaffolding floors 44 are suspended by the suspension hooks 32 thereof in the U profile 31 of the U-section beam 24 in such a way that the suspension hooks 32 thereof rest on the support edges 50.1, 50.2 of the two support limbs 33.1, 33.2 of the U profile 31 of the U-section beam 24. In the embodiment shown in FIGS. 17 to 19 several scaffolding floors 44 are arranged with their mutually opposite longitudinal ends, as considered in transverse direction, adjacent to one another on each side of the U profile 31 of the U-section beam 24. In that case, the suspension hooks 32 of a first number of scaffolding floors 44 rest on the support edge 50.1 of a first support limb 33.1 of the two support limbs 33.1, 33.2 of the U profile 31 of the U-section beam 24 and the suspension hooks 32 of the second number of further scaffolding floors 44 rest on the support edge 50.2 of the second support limb 33.2 of the support limbs 33.1, 33.2 of the U profile 31 of the U-section beam 24. In that case, the scaffolding floors 44 are arranged in such a way that in each instance two of the scaffolding floors 44, which lie on either side of the U profile 31 of the U-section beam 24, are disposed approximately in a straight line.

After suspension of the suspension hooks 32 of the scaffolding floors 44 in the U profile 31 of the U-section beam 24 an anti-lift-out and support body 60 according to the invention is mounted on the U-section beam 24 in such a way that it is supported by support body ends 79.1, 79.2.1, 79.2.2, 79.2.3, 79.3 of its support bodies 59.1, 59.2, 59.3 on the groove base 62 of the guide groove 58 of the transverse wall 38 of the U-section beam 24 and engages by its anti-lift-out body 67 over the associated suspension hooks 32 of the scaffolding floors 44. For this purpose, the anti-lift-out and support body 60 is vertically inserted by its support bodies 59.1, 59.2, 59.3 from above vertically downwardly through between the mutually opposite suspension hooks of the scaffolding floors 44.

Subsequently thereto, in the illustrated embodiment one of the fastening devices 71.2, which is configured as the quick-action locking device 96.2, is mounted. For this purpose, an assembler (not shown) grips the securing flap 11 by one of his or her hands, preferably in that the assembler grips by one or two of his or her fingers through the grip opening 131 of the securing flap 111. Due to the pivotable coupling of the fastening body 73.2 to the securing flap 111 the fastening body 73.2 then hangs under gravitational force, together with the locking body 74.2, vertically or perpendicularly downwards. If it has not yet taken place, the assembler then rotates—still freely holding the securing flap 111 in his or her hand—the securing flap 111 so that the locking body 74.2 transfers into an insertion setting 99.2 in which it can be inserted from above through one of the passage openings 81.1 of the anti-lift-out body 67 of the anti-lift-out and support body 60 (see FIG. 17). Subsequently thereto the assembler, still holding the securing flap 111 freely in his or her hand, guides or inserts the locking body 74.2 vertically downwardly through the said passage opening 81.1 of the anti-lift-out body 67 of the anti-lift-out and support body 60 and continues this introduction or insertion movement vertically downwardly until the securing body 75.2 of the securing flap 111 rests on the outer surface 88 of the anti-lift-body 67 of the anti-lift-out and support body 60 (see FIGS. 18 and 10).

Subsequently thereto the assembler, still holding the securing flap 111 in his or her hand, turns the securing flap 111 through an angle of approximately 90 degrees about the fastening body longitudinal axis 76.2 of the fastening body 73.2, whereby as a consequence of the construction the locking body 74.2 is co-rotated at the same time through this angle about the fastening body longitudinal axis 76.2 (see FIG. 18). The locking body 74.2 is then in a locking setting 97.2 (see FIG. 18) in which it engages behind the groove engagement-behind webs 53.1, 53.2 of the guiding and fastening groove 51 of the U-section beam 24 (see FIG. 8).

During that or at the same time or subsequently the assembler, still holding the securing flap 111 in his or her hand, rotates the securing flap 11 about the transverse axis 114 in direction towards the outer surface 88 of the anti-lift-out body 67 of the anti-lift-out and support body 60 until the securing flap 111 lies by the plate-shaped section 129 thereof on the said outer surface 88 of the anti-lift-out body 67 so that then a securing setting 116 of the securing flap 111 is achieved, in which its anti-twist body 134 engages in an associated securing passage 135 of the anti-lift-out body 67 (see FIGS. 18 and 9). In this securing setting 116 of the securing flap 111 a securing against unintended rotation of the securing flap 111 about the fastening body longitudinal axis 76.2 and consequently against unintended rotation of the locking body 74.2 from its locking setting 97.2 into its unlocking setting 98.2 is achieved.

The anti-lift-out and support body 60, even when the locking body 74.2 of the quick-action locking device 96.2 is in its locking setting 97.2, is displaceable in a displacement direction parallel to the U-section beam longitudinal axis 34 relative to the U-section beam 24 or along the U-section beam 24 and, in particular, regardless of the pivot setting in which in that case the securing flap 111 is disposed relative to the fastening body or the anti-lift-out body 67, thus, in particular, also in the securing setting 116 of the securing flap 111.

REFERENCE NUMERAL LIST

20 scaffolding/hanging scaffolding
21.1 hanging device
21.2 hanging device
22 support device
23 fastening device/suspension shoe
24 U-section beam
24.1 U-section beam
24.2 U-section beam
25 threaded rod
26 threaded rod end
27 support plate
28.1 (first) side plate
28.2 (second) side plate
29 support plate
30 receiving space
31 U profile of 24
32 suspension hook/U-shaped claw
33.1 (first) support limb
33.2 (second) support limb
34 U-section beam longitudinal axis
35 lower wall of 24
36.1 (first) side wall of 24
36.2 (second) side wall of 24
37 transverse spacing/width of 24
38 transverse wall of 24
39 fastening hole
40 connection adapter
41.1 (first) longitudinal row
41.2 (second) longitudinal row
42 height spacing
43 hole spacing
44 scaffolding floor
45 cavity profile member of 24
46 longitudinal centre plane of 24
47 cavity profile member width
48 cavity profile member height
49 longitudinal centre plane of 31
50.1 support edge of 33.1
50.2 support edge of 33.2
51 guiding and fastening groove
52 longitudinal axis of 51
53.1 (first) groove engagement-behind web
53.2 (second) groove engagement-behind web
54.1 end of 53.1
54.2 end of 53.2
55 longitudinal slot
56 locking space
57 (maximum) width of 59.1, 59.2, 59.3
58 guide groove
59.1 support body
59.2 support body
59.3 support body
60 anti-lift-out and support body
61 longitudinal centre plane of 58
62 groove base of 58
63 transverse wall part of 38
64 fastening means/bolt
65 support connecting device
66 (narrow) end face of 44
67 anti-lift-out body
68 anti-lift-out body longitudinal axis
69 cavity
70.1 anti-lift-out device
70.2 anti-lift-out device
71.1 fastening device
71.2 fastening device
72 (minimum) guide groove width
73.1 fastening body of 71.1
73.2 fastening body of 71.2
74.1 locking body of 71.1
74.2 locking body of 71.2
75.1 securing body of 71.1
75.2 securing body 71.2
76.1 fastening body longitudinal axis of 73.1
76.2 fastening body longitudinal axis of 73.2
77.1 locking body longitudinal axis of 74.1
77.2 locking body longitudinal axis of 74.1
78.1 spacing
78.2 spacing
79.1 support body end of 59.1
79.2.1 support body end of 59.2
79.2.2 support body end of 59.2
79.2.3 support body end of 59.2
79.3 support body end of 59.3
80.1 support body spacing
80.2 support body spacing
81.1 passage opening
81.2 passage opening
82 (maximum) anti-lift-out body width of 67
83 height of 60
84 transverse centre of 60
85 support body wall thickness
86 anti-lift-out body wall thickness
87 T profile cross-section
88 outer area/outer surface of 60
89 (first) spacing
90.1 locking surface(s) of 74.1
90.2 locking surface(s) of 74.2
91 (second) spacing
92 support limb spacing
93 (displacement) gap
94 spacing
95.1 U-section beam end of 24
95.2 U-section beam end of 24
96.1 clamping-fast device
96.2 quick-action locking device
97.1 locking setting of 74.1
97.2 locking setting of 74.2
98.1 unlocking setting of 74.1
98.2 unlocking setting of 74.2
99.2 insertion setting of 74.2
100 screw-and-nut locking unit
101 (first) threaded body/(cylinder) screw

102 (second) threaded body/(hexagonal) nut
103 (first) (external) thread
104 (second) (internal) thread
105.1 radiused edge
105.2 edge
105.3 radiused edge
105.4 edge
106.1 locking body width of 74.1
106.2 locking body width of 74.2
107.1 locking body length of 74.1
107.2 locking body length of 74.2
108 shank of 101
109 washer
110 securing flap locking unit
111 securing flap
112 U-section beam height
113 fastening body end of 73.2
114 transverse axis
115.1 manipulation setting
115.2 manipulation setting
116 securing setting
117.1 locking body end of 74.1
117.2 locking body end of 74.1
118.1 locking body end of 74.2
118.2 locking body end of 74.2
119.1 transition region
119.2 transition region
120 (height) region
121 flat web
122 flat web longitudinal axis
123 flat web height
124 (maximum) width of 121
125 (maximum) thickness of 121
127 (minimum) spacing
128 metal plate
129 (plate-shaped) section
131 grip opening
132.1 securing flap end
132.2 securing flap end
133 web
134 anti-twist body
135 securing passage
136.1 actuating limb
136.2 actuating limb
137.1 (first) direction
137.2 (second) direction
138 bearing body/bearing dowel
140.1 bearing body end
140.2 bearing body end
141.1 fastening and bearing strap
141.2 fastening and bearing strap
142 transverse centre plane of 60
143 longitudinal centre plane of 60

The invention claimed is:

1. A scaffolding (20), comprising a U-section beam (24), which extends along a U-section beam longitudinal axis (34) and has an outwardly open U profile (31), and comprising at least one scaffolding floor (44), which is detachably fixed to the U profile (31) and which has at an end (66) one or more suspension hooks (32) for suspension in the U profile (31), and comprising at least one anti-lift-out device (70.1, 70.2), which is detachably connected with the U-section beam (24) and which includes a fastening device (71.1, 71.2) and an anti-lift-out body (67), wherein the U profile (31) of the U-section beam (24) has support limbs (33.1, 33.2) which are arranged parallel to one another and parallel to a longitudinal center plane (49) of the U profile (31) and are connected together by a transverse wall (38) and which have support edges (50.1, 50.2) for laying-on of the suspension hook (32) or the suspension hooks (32) of the at least one scaffolding floor (44) and wherein the suspension hook or hooks (32) of the at least one scaffolding floor (44) is or are detachably laid on at least one support edge (50.1, 50.2) of the support edges (50.1, 50.2), and wherein the U-section beam (24) has a guiding and fastening groove (51), which is bounded by the transverse wall (38) and is open in the direction of the support edges (50.1, 50.2) of the support limbs (33.1, 33.2) as well as towards inner sides of the two support limbs and which extends in a transverse direction transversely to the support limbs (33.1, 33.2) and, with formation of a longitudinal slot (55), is bounded by groove engagement-behind webs (53.1, 53.2), which are arranged along the inner sides of the two support limbs (33.1, 33.2) and extend respectively inwardly therefrom and which bound a locking space (56) of the guiding and fastening groove (51), in which a locking body (74.1, 74.2) can be releasably arranged at several positions along the guiding and fastening groove (51), and wherein the fastening device (71.1, 71.2) of the anti-lift-out device (70.1, 70.2) comprises a fastening body (73.1, 73.2), the locking body (74.1, 74.2) and a securing body (75.1, 75.2), and wherein the fastening body (73.1, 73.2) extends in the direction of the fastening body longitudinal axis (76.1, 76.2) transversely or perpendicularly to the anti-lift-out body (67), and wherein the securing body (75.1, 75.2) is arranged at the fastening body (73.1, 73.2) at a spacing (78.1, 78.2) from the locking body (74.1, 74.2), and wherein the locking body (74.1, 74.2) is fastened to the fastening body (73.1, 73.2) and extends in the direction of the locking body longitudinal axis (77.1, 77.2) transversely or perpendicularly to the fastening body longitudinal axis (76.1, 76.2) of the fastening body (73.1, 73.2), and wherein the locking body (74.1, 74.2) is transferred into a locking setting (97.1, 97.2) in which it engages behind the groove engagement-behind webs (53.1, 53.2) of the guiding and fastening groove (51) and in which it is releasably fastened in the locking space (56) of the guiding and fastening groove (51), and wherein the locking body (74.1, 74.2) is rotatable by means of or by way of the fastening body (73.1, 73.2) about the fastening body longitudinal axis (76.1, 76.2) from the locking setting (97.1, 97.2) into an unlocking setting (98.1, 98.2) in which the locking body (74.1, 74.2) is movable by means of or by way of the fastening body (73.1, 73.2) in a direction transverse or perpendicular to the longitudinal axis (52) of the guiding and fastening groove (51) away from the transverse wall (38) out of the guiding and fastening groove (51) through the longitudinal slot (55), and wherein the anti-lift-out body (67) has a passage opening (81.1, 81.2) through which the fastening body (73.1, 73.2) is inserted so as to be rotatable about the fastening body longitudinal axis (76.1, 76.2) relative to the anti-lift-out body (67), and wherein the anti-lift-out body (67) engages over the suspension hook or hooks (32), and wherein the anti-lift-out body (67) by means of the securing body (75.1, 75.2) by way of the fastening body (73.1, 73.2) and the locking body (74.1, 74.2) secures the suspension hook or hooks (32) against lifting out of the U profile (31) in a direction transverse or perpendicular to the U section beam longitudinal axis (34), wherein the anti-lift-out body (67) extending in the direction of the anti-lift-out body longitudinal axis (68) is a component of an anti-lift-out and support body (60) comprising a support body (59.1, 59.2, 59.3) which is fixedly or rigidly connected with the anti-lift-out body (67) and extends transversely or perpendicularly away from the anti-lift-out body (67) up to the support body end (79.1, 79.2.1, 79.2.2, 79.2.3, 79.3) and which is supported by the support body end (79.1, 79.2.1, 79.2.2, 79.2.3, 79.3) on the transverse wall (38) of the U-section beam (24) and the passage opening (81.1, 81.2) of the anti-lift-out body (67) is formed in such a way that the locking body (74.1, 74.2) is movable by means of or by way of the fastening body (73.1, 73.2) in the direction of the fastening body longitudinal axis (76.1, 76.2) as well as transversely or perpendicularly to the longitudinal axis (52) of the guiding and fastening groove (51) through the passage opening (81.1, 81.2) of the anti-lift-out body (67).

2. The scaffolding according to claim 1, wherein a gap (93) is formed between the anti-lift-out body (67) of the anti-lift-out and support body (67) and the suspension hook or hooks (32), which is or are engaged over by the anti-lift-out body (67), of the at least one scaffolding floor (44).

3. The scaffolding according to claim 1, wherein the transverse wall (38) of the U-section beam (24) has a guide groove (58), which is open towards the locking space (56) of the guiding and fastening groove (51) and which extends in a guide groove longitudinal direction parallel to the longitudinal axis (52) of the guiding and fastening groove (51), and the support body (59.1, 59.2, 59.3) is supported by the support body end (79.1, 79.2.1, 79.2.2, 79.2.3, 79.3) on a groove base (62) of the guide groove (58) of the transverse wall (38) of the U-section beam (24).

4. The scaffolding according to claim 1, wherein the fastening device (71.1) is a clamping-fast device (96.1) comprising a screw-and-nut locking unit (100) in which a screw (101) and a nut (102) are screwed together and the fastening body (73.1) is a first threaded body with a first thread (103), which is screwed together with a second thread (104) of the securing body (75.1), which is formed as a second threaded body (102).

5. The scaffolding according to claim 4, wherein the anti-lift-out and support body (60) is so detachably screw-connected by means of the screw-and-nut locking unit (100) of the clamping-fast device (96.1) with the U-section beam (24) that the anti-lift-out and support body (60) is neither displaceable along the U-section beam nor displaceable parallel to the U-section beam longitudinal axis (34).

6. The scaffolding according to claim 4, wherein the anti-lift-out and support body (60) is secured by means of a first fastening device and by means of a second fastening device to the U-section beam (24) against lifting of the suspension hook (32) or the suspension hooks (32) of the at least one scaffolding floor (44) out of the U profile (31) of the U-section beam (24), wherein the first fastening device and the second fastening device as considered in the direction of the U-section beam longitudinal axis (34) of the U-section beam (24) are arranged at a mutual spacing (94), and the first fastening device is the clamping-fast device and the second fastening device is the quick-action locking device or the first fastening device is the clamping-fast device and the second fastening device is a corresponding or the same clamping-fast device or the first device is the quick-action locking device and the second fastening device is a corresponding or the same quick-action locking device, and the anti-lift-out body (67) has a number, which corresponds with the number of fastening devices, of passage openings (81.1, 81.2) which are respectively formed in a such a way that the respective locking body together with a fastening body part of the respective fastening body is insertable in the direction of the fastening body longitudinal axis as well as perpendicularly to the longitudinal axis (52) of the fastening groove (51) through the respective passage opening (81.1, 81.2).

7. The scaffolding according to claim 1, wherein the fastening device (71.2) is a quick-action locking device (96.2) comprising a securing element locking unit (110) with a securing element (111), which unit embraces or engages around the securing body (75.2) and is fastened to a fastening body end (113)—which faces away from the locking body (74.2)—of the fastening body (73.2) to be pivotable about a transverse axis (114), which extends transversely or perpendicularly to the fastening body longitudinal axis (76.2), from at least one manipulation setting (115.1, 115.2) into a securing setting (116) relative to the anti-lift-out and support body (60), in which securing setting the securing element (111) and the fastening body (73.2) pivotably fastened thereto and the locking body (74.2) fastened thereto are secured against unintended rotation about the fastening body longitudinal axis (76.2) from the locking setting (97.2) of the locking body (74.2) into the unlocking setting (98.2) of the locking body (74.2).

8. The scaffolding according to claim 7, wherein the anti-lift-out and support body (60) is detachably fastened by means of the quick-action locking device (96.2) to the U-section beam (24) in such a way that the anti-lift-out and support body (60) at least in the at least one manipulation setting (115.1, 115.2) of the securing element (111) or in both the at least one manipulation setting (115.1, 115.2) of the securing element (111) and the securing setting (116) of the securing element (111) or in all pivot settings, in which the securing element (111) in the mounted state of the quick-action locking device (96.2) is pivotable about the transverse axis (114) relative to the anti-lift-out and support body (60), is displaceable in a displacement direction parallel to the U-section beam longitudinal axis (34) relative to the U-section beam (24).

9. The scaffolding according to claim 7, wherein the securing body (75.2) and the locking body (74.2) as considered in the direction of the fastening body longitudinal axis (76.2) are substantially not movable or displaceable or substantially not movable or displaceable relative to one another.

10. The scaffolding according to claim 7, wherein the fastening body (73.2), which extends along the fastening body longitudinal axis (76.2), of the quick-action locking device (96.2) is formed in a region (120) between the locking body (74.2) and the securing body (75.2) with a flat web (121) extending in a direction along or parallel to the anti-lift-out body longitudinal axis (68).

11. The scaffolding according to claim 7, wherein the securing element (111) comprises an anti-twist body (134) which in the securing setting (116) of the securing element (111) engages in a securing recess or securing passage (135) of the anti-lift-out body (67).

12. The scaffolding according to claim 7, wherein the support body end (79.1, 79.2.1, 79.2.2, 79.2.3, 79.3) of the support body (59.1, 59.2, 59.3) has a first spacing (89) from an outer surface (88), which faces away therefrom, of the anti-lift-out body (67), and the securing body (75.2) as considered in a direction parallel to the fastening body longitudinal axis (76.2) has a second spacing (91)—which is greater than the first spacing (89)—from locking surfaces (90.2), which are opposite the securing body, of the locking body (74.2).

13. The scaffolding according to claim 1, wherein the anti-lift-out and support body (60) comprises a plurality of support bodies (59.1, 59.2, 59.3), which are respectively fixedly or rigidly connected with the anti-lift-out body (67) and respectively extend transversely or perpendicularly away from the anti-lift-out body (67) and which as considered in a direction parallel to the anti-lift-out body longitudinal axis (68) are aligned with one another and as considered in the direction of the anti-lift-out body longitudinal axis (68) have a or a respective mutual support body spacing (80.1, 80.2).

14. A method of securing at least one scaffolding floor (44) of scaffolding (20) against lifting out of one or more suspension hooks (32), which are arranged at an end (66) of the at least one scaffolding floor (44), from a U profile (31) of a U-section beam (24), wherein the outwardly open U profile (31) of the U-section beam (24), which extends along the U-section beam longitudinal axis (34), has support limbs (33.1, 33.2), which are arranged parallel to one another and parallel to a longitudinal center plane (49) of the U profile (31) and are connected together by a transverse wall (38) and which have support edges (50.1, 50.2) for laying-on of the suspension hook (32) or the suspension hooks (32) of the at least one scaffolding floor (44), and wherein the U-section beam (24) has a guiding and fastening groove (51), which is bounded by the transverse wall (38) and is open in the direction of the support edges (50.1, 50.2) of the support limbs (33.1, 33.2) as well as towards inner sides of the two support limbs and which extends in a transverse direction transversely to the support limbs (33.1, 33.2) and, with formation of a longitudinal slot (55), is bounded by groove engagement-behind webs (53.1, 53.2), which are arranged along the inner sides of the two support limbs (33.1, 33.2) and extend respectively inwardly therefrom and which bound a locking space (56) of the guiding and fastening groove (51), in which a locking body (74.1, 74.2) can be releasably arranged at several positions along the guiding and fastening groove (51), wherein in a first method step the suspension hook or hooks (32) of the at least one scaffolding floor (44) is or are detachably laid on at least one support edge (50.1, 50.2) of the support edges (50.1, 50.2) of the support limbs (33.1, 33.2) of the U profile (31) of the U-section beam (24), wherein in a succeeding second method step at least one anti-lift-out device (70.2, 70.2), which includes an anti-lift-out body (67) and a fastening device (71.1, 71.2), which comprises a fastening body (73.1, 73.2), the locking body (74.1, 74.2) and a securing body (75.1, 75.2), wherein the fastening body (73.1, 73.2) extends in the direction of the fastening body longitudinal axis (76.1, 76.2) transversely or perpendicularly to the anti-lift-out body (67) and wherein the securing body (75.1, 75.2) is arranged at the fastening body (73.1, 73.2) at a spacing (78.1, 78.2) from the locking body (74.1, 74.2) and wherein the locking body (74.1, 74.2) is fastened to the fasting body (73.1, 73.2) and extends in the direction of the locking body longitudinal axis (77.1, 77.2) transversely or perpendicularly to the fastening body longitudinal axis (76.1, 76.2) of the fastening body (73.1, 73.2), is mounted in such a way that the anti-lift-out body (67) engages over the suspension hook or hooks (32) of the at least one scaffolding floor (44) and is detachably fastened by means of the securing body (75.1, 75.2) by way of the fastening body (73.1, 73.2) and the locking body (74.1, 74.2) to the U-section beam (24) in such a way that the suspension hook or hooks (32) is or are secured against lifting in a direction transverse or perpendicular to the U-section beam longitudinal axis (34) out of the U profile (31), wherein during performance of the second method step the locking body (74.1, 74.2) is transferred into an insertion setting (99.2) in which it is inserted in a direction transverse or perpendicular to the longitudinal axis (52) of the guiding and fastening groove (51) towards the transverse wall (38) through the longitudinal slot (55) into the guiding and fastening groove (51), wherein the locking body (74.1, 74.2) is then disposed in an unlocking setting (98.1, 98.2), after which the locking body (74.1, 74.2) is rotated by means of or by way of the fastening body (73.1, 73.2) about the fastening body longitudinal axis (76.1, 76.2) relative to the U profile (31) in the guiding and fastening groove (51) until in a locking setting (98.1, 98.2) in which the locking body (74.1, 74.2) engages behind the groove engagement-behind webs (53.1, 53.2) of the guiding and fastening groove (51) and in which it is releasably fastened in the locking space (56) of the guiding and fastening groove (51), wherein during performance of the second method step an anti-lift-out and support body (60) which includes the anti-lift-out body (67), which extends in the direction of the anti-lift-out body longitudinal axis (68), and a support body (59.1, 59.2, 59.3), which is fixedly or rigidly connected with the anti-lift-out body (67) and extends transversely or perpendicularly away from the anti-lift-out body (67) up to the support body end (79.1, 79.2.1, 79.2.2, 79.2.3, 79.3), is so arranged that the support body end (79.1, 79.2.1, 79.2.2, 79.2.3, 79.3) of the support body (59.1, 59.2, 59.3) is supported on the transverse wall (38) of the U-section beam (24)

and the locking body (74.1, 74.2) is inserted by means of or by way of the fastening body (73.1, 73.2) in the direction of the fastening body longitudinal axis (76.1, 76.2) as well as transversely or perpendicularly to the longitudinal axis (52) of the guiding and fastening groove (51) through a passage opening (81.1, 81.2) of the anti-lift-out body (67) of the anti-lift-out and support body (60) and subsequently is inserted by means of or by way of the fastening body (73.1, 73.2) in the direction of the fastening body longitudinal axis (76.1, 76.2) as well as transversely or perpendicularly to the longitudinal axis (52) of the guiding and fastening groove (51) through the longitudinal slot (55) into the guiding and fastening groove (51), wherein then the locking body (74.1, 74.2) is disposed in the unlocking setting (98.1, 98.2), after which the locking body (74.1, 74.2) by means of or by way of the fastening body (73.1, 73.2) is rotated about the fastening body longitudinal axis (76.1, 76.2) relative to the U profile (31) into the locking setting (97.1, 97.2).

15. The method according to claim 14, wherein during performance of the second method step the support body (59.1, 59.2, 59.3) of the anti-lift-out and support body (60) is inserted by the support body end (79.1, 79.2.1, 79.2.2, 79.2.3, 79.3) in a direction transverse or perpendicular to the longitudinal axis (52) of the guiding and fastening groove (51) through the longitudinal slot (55) into the guiding and fastening groove (51), after which the support body (59.1, 59.2, 59.3) penetrating the guiding and fastening groove (51) transversely or perpendicularly to the longitudinal axis (52) is supported by the support body end (79.1, 79.2.1, 79.2.2, 79.2.3, 79.3) on the transverse wall (38) of the U section beam (24).

* * * * *